US011571899B2

(12) United States Patent
Arakane et al.

(10) Patent No.: US 11,571,899 B2
(45) Date of Patent: Feb. 7, 2023

(54) LIQUID DISCHARGING APPARATUS, CONTROLLING METHOD FOR THE SAME, AND MEDIUM STORING PROGRAM

(71) Applicant: BROTHER KOGYO KABUSHIKI KAISHA, Nagoya (JP)

(72) Inventors: Satoru Arakane, Nagoya (JP); Shotaro Iida, Nagoya (JP); Shin Hasegawa, Nagoya (JP); Yasuhiro Nakano, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 99 days.

(21) Appl. No.: 17/241,207

(22) Filed: Apr. 27, 2021

(65) Prior Publication Data

US 2021/0339531 A1 Nov. 4, 2021

(30) Foreign Application Priority Data

Apr. 30, 2020 (JP) ..... JP2020-080201

(51) Int. Cl.
*B41J 2/165* (2006.01)

(52) U.S. Cl.
CPC ..... *B41J 2/1652* (2013.01); *B41J 2/16505* (2013.01); *B41J 2/16526* (2013.01)

(58) Field of Classification Search
CPC ..... B41J 2/1652; B41J 2/16505; B41J 2/16526
See application file for complete search history.

(56) References Cited

U.S. PATENT DOCUMENTS 6,193,351 B1 2/2001 Yaegashi et al.
10,150,298 B2 * 12/2018 Arakane ..... B41J 2/16505

FOREIGN PATENT DOCUMENTS

JP 9-207358 A 8/1997
JP 2003-80702 A 3/2003

* cited by examiner

*Primary Examiner* — Sharon Polk
(74) *Attorney, Agent, or Firm* — Merchant & Gould P.C.

(57) ABSTRACT

A liquid discharging apparatus includes a controller configured to execute: a recording processing, a first determining processing, a pre-recording flushing processing, a first flushing processing, and a second flushing processing. In a case that the controller determines, by the first determining processing, that the recording processing is to be executed in the second mode, the controller is configured to make a first flushing interval between the pre-recording flushing processing and the first flushing processing to be longer than a second flushing interval between the first flushing processing and the second flushing processing.

15 Claims, 16 Drawing Sheets

LIQUID DISCHARGING APPARATUS, CONTROLLING METHOD FOR THE SAME, AND MEDIUM STORING PROGRAM

CROSS REFERENCE TO RELATED APPLICATION

The present application claims priority from Japanese Patent Application No. 2020-080201, filed on Apr. 30, 2020, the disclosure of which is incorporated herein by reference in its entirety.

BACKGROUND

Field of the Invention

The present disclosure relates to a liquid discharging apparatus, a method for controlling the same, and a medium storing a program.

Description of the Related Art

As a conventional liquid discharging apparatus, there is known an ink-jet printing apparatus described in Patent Japanese Patent Application Laid-open No. 2003-080702. In this ink-jet printing apparatus, in a case that a preliminary discharging step is performed a plurality of times at a predetermined interval, the preliminary discharging step is executed such that the interval for executing the preliminary discharging step is shortened in a stepwise manner.

SUMMARY

In a case that the interval for executing the preliminary discharging step is shorted uniformly, as in the above-described ink-jet printing apparatus, a number of times of executing the preliminary discharging step becomes great, and the printing time thus becomes long. On the other hand, in a case that the interval for executing the preliminary discharging step is made to be long, a liquid inside a nozzle is dried, which in turn lowers the print quality.

The present disclosure has been made so as to solve the above-described problem, and an object of the present disclosure is to provide a liquid discharging apparatus, a method for controlling the same, and a program, each of which is capable of balancing the quality of a printed image and the printing time.

According to a first aspect of the present disclosure, there is provided a liquid discharging apparatus comprising:

a head having a discharge surface in which a nozzle is opened;

a cap configured to cover the discharge surface;

a receiving part configured to receive liquid discharged from the head;

a moving device configured to move the cap between a capping position at which the cap covers the discharge surface, and an uncapping position at which the cap is separated from the discharge surface; and a controller configured to execute:

a recording processing of discharging the liquid from the nozzle to a recording medium based on print data;

a first determining processing of determining, based on the print data, whether the recording processing is to be executed in a first mode or a second mode in which a processing speed is faster than that in the first mode;

a pre-recording flushing processing of discharging the liquid from the nozzle to the receiving part after uncapping of the cap and before the recording processing;

a first flushing processing of discharging the liquid from the nozzle to the receiving part in the recording processing; and a second flushing processing of discharging the liquid from the nozzle to the receiving part in the recording processing, the second flushing processing being executed after the first flushing processing, wherein in a case that the controller determines, by the first determining processing, that the recording processing is to be executed in the second mode, the controller is configured to make a first flushing interval between the pre-recording flushing processing and the first flushing processing to be longer than a second flushing interval between the first flushing processing and the second flushing processing.

According to a second aspect of the present disclosure, there is provided a controlling method of controlling a liquid discharging apparatus including:

a head having a discharge surface in which a nozzle is opened;

a cap configured to cover the discharge surface;

a receiving part configured to receive liquid discharged from the head;

a moving device configured to move the cap between a capping position at which the cap covers the discharge surface, and an uncapping position at which the cap is separated from the discharge surface; and a controller, the controlling method comprising causing the controller to execute:

a recording processing of discharging the liquid from the nozzle to a recording medium based on print data;

a first determining processing of determining, based on the print data, whether the recording processing is to be executed in a first mode or a second mode in which a processing speed is faster than that in the first mode;

a pre-recording flushing processing of discharging the liquid from the nozzle to the receiving part after uncapping of the cap and before the recording processing;

a first flushing processing of discharging the liquid from the nozzle to the receiving part in the recording processing; and a second flushing processing of discharging the liquid from the nozzle to the receiving part in the recording processing, the second flushing processing being executed after the first flushing processing, and in a case that the controller determines, by the first determining processing, that the recording processing is to be executed in the second mode, the controlling method causing the controller to make a first flushing interval between the pre-recording flushing processing and the first flushing processing to be longer than a second flushing interval between the first flushing processing and the second flushing processing.

According to a third aspect of the present disclosure, there is provided a non-transitory medium storing a program executable by a liquid discharging apparatus including:

a head having a discharge surface in which a nozzle is opened;

a cap configured to cover the discharge surface;

a receiving part configured to receive liquid discharged from the head;

a moving device configured to move the cap between a capping position at which the cap covers the discharge surface, and an uncapping position at which the cap is separated from the discharge surface; and a controller, in a case that the program is executed by a processor of the liquid discharging apparatus, the program causing the controller to execute:

a recording processing of discharging the liquid from the nozzle to a recording medium based on print data;

a first determining processing of determining, based on the print data, whether the recording processing is to be executed in a first mode or a second mode in which a processing speed is faster than that in the first mode;

a pre-recording flushing processing of discharging the liquid from the nozzle to the receiving part after uncapping of the cap and before the recording processing;

a first flushing processing of discharging the liquid from the nozzle to the receiving part in the recording processing; and a second flushing processing of discharging the liquid from the nozzle to the receiving part in the recording processing, the second flushing processing being executed after the first flushing processing, wherein in a case that the controller determines, by the first determining processing, that the recording processing is to be executed in the second mode, the program causes the controller to make a first flushing interval between the pre-recording flushing processing and the first flushing processing to be longer than a second flushing interval between the first flushing processing and the second flushing processing.

The present disclosure has the configuration as explained above, and achieves an effect that a liquid discharging apparatus, a method for controlling the same, and a program, each of which is capable of realizing a high-speed printing, while suppressing any unsatisfactory discharge due to increase in the viscosity of the liquid.

The above-described object, another object, the characteristic and the advantage of the present disclosure will be specified with reference to the attached drawings and the following specific explanation of an embodiment of the present disclosure.

DESCRIPTION OF THE EMBODIMENTS

Figure 1:
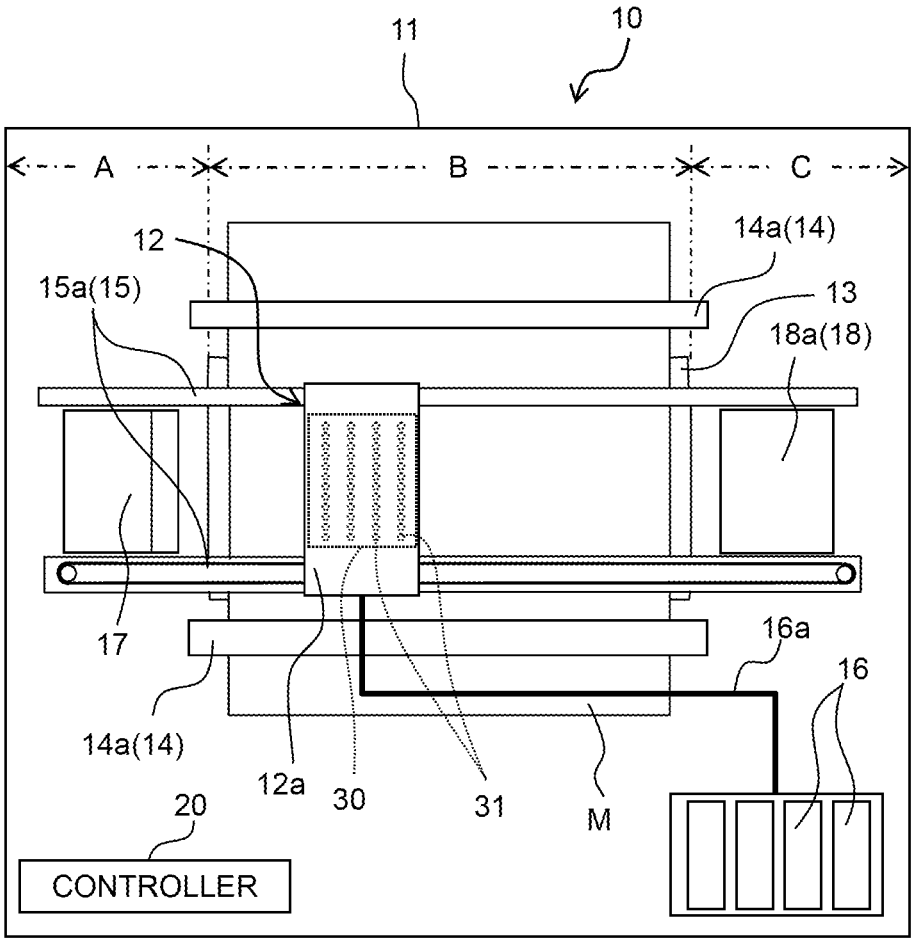
FIG. 1 is a schematic view of a liquid discharging apparatus according to a first embodiment of the present disclosure, as seen from above.
Figure 1:
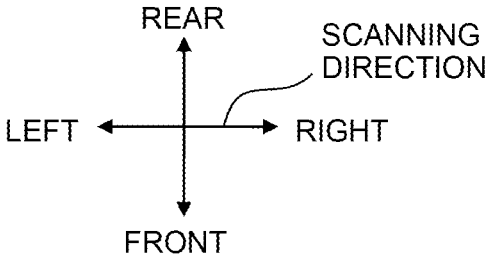

In the following, an embodiment of the present disclosure will be specifically explained, with reference to the drawings. Note that in the following explanation, a same reference numeral is affixed to a same or corresponding element (part, section, etc.) throughout all the drawings, and any overlapping explanation therefor will be omitted.

First Embodiment

Configuration of Liquid Discharging Apparatus

A liquid discharging apparatus 10 according to a first embodiment of the present disclosure is an apparatus which discharges or ejects a liquid such as an ink, etc., to a recording medium M, as depicted in FIG. 1; the liquid discharging apparatus 10 is, for example, an ink-jet printer. The liquid discharging apparatus 10 adopts a serial head system and includes: a casing 11, a head unit 12, a platen 13, a conveying device 14, a scanning device 15, a storing tank 16, a receiving part 17, a maintenance unit 18 and a controller 20.

Note that a side of the head unit 12 with respect to the platen 13 is referred to as "above" or "upper side", and a side opposite thereto is referred to as "below" or "lower side". Further, a direction in which the recording medium M is conveyed by the conveying device 14 (conveying direction) is referred to as "rear" or "rear side", and a side opposite thereto is referred to as "front" or "front side". A direction in which the head unit 12 is moved by the scanning device 15 (scanning direction) is referred to as a left-right direction. This scanning direction crosses (for example, is orthogonal to) the conveying direction. Note, however, that the direction of arranging the liquid discharging apparatus 10 is not limited to or restricted by this. Further, the details of the controller 20 will be described later on.

The casing 11 stores or accommodates respective parts (sections, elements, units, etc.) of the liquid discharging apparatus 10. In the inside of the casing 11, a flushing area A, a recording area B and a maintenance area C are provided in the left-right direction. The flushing area A is arranged on one side (left side) in the left-right direction with respect to the recording area B, and the maintenance area C is arranged on the other side (right side) in the left-right direction with respect to the recording area B. The recording area B is arranged between the flushing area A and the maintenance area C in the left-right direction, and is adjacent to both of the flushing area A and the maintenance area C.

The head unit 12 has a carriage 12*a* and a head 30. The head 30 is mounted on the carriage 12*a*, and moves reciprocally in the left-right direction, together with the carriage 12*a*.

Figure 2A:
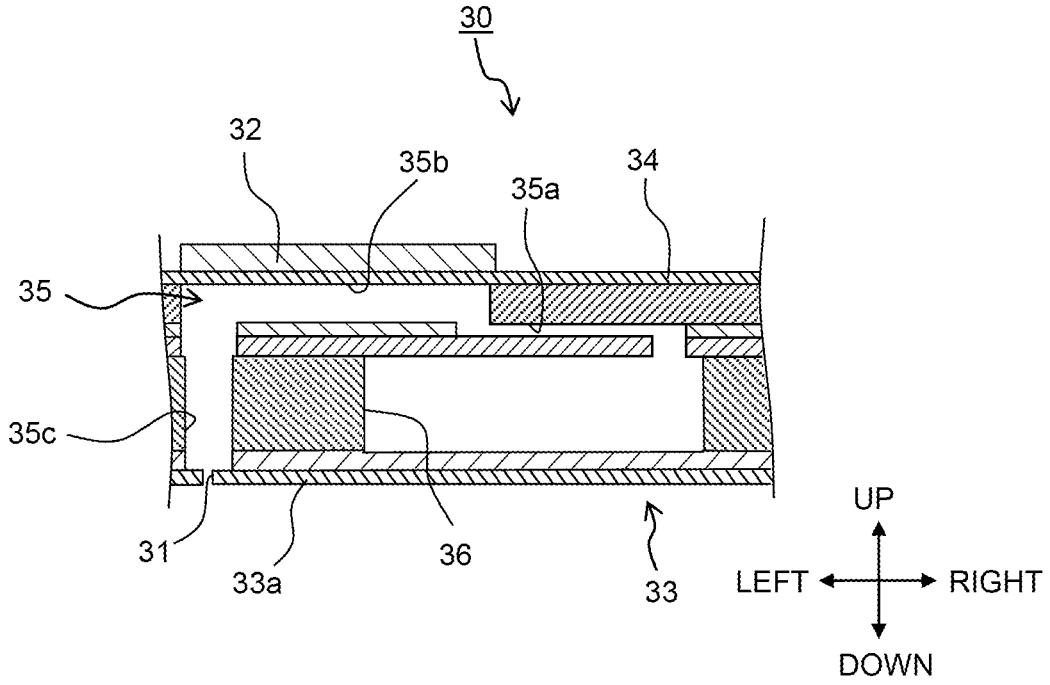
FIG. 2A is a cross-sectional view schematically depicting a head of FIG. 1.

The head 30 has a plurality of nozzles 31, a plurality of driving elements 32 (FIG. 2A) and a channel forming body 33 (FIG. 2A). A plurality of liquid channels are formed in the inside of the channel forming body 33, and the plurality of nozzles 31 each of which corresponds to one of the plurality of liquid channels are opened in a lower surface (discharge surface 33*a*) of the channel forming body 33. The plurality of nozzles 31 form a plurality of (for example, four) nozzle arrays. Each of the plurality of nozzle arrays is formed of nozzles arranged side by side in the front-rear direction. In a case that each of the plurality of driving elements 32 is driven so as to change the volume of a liquid channel included in the plurality of liquid channels and corresponding thereto, thereby vibrating the meniscus of a nozzle 31 included in the plurality of nozzles 31 and corresponding thereto, and consequently discharging (ejecting) a droplet of a liquid (liquid droplet) from the nozzle 31. With this, an image is recoded on the recording medium M. Namely, the head 30 has the plurality of nozzles 31 for discharging the liquid. The specific of the head 30 will be explained later on.

The platen 13 is arranged in the recording area B, is a member having a shape of a flat plate, and the recording medium M is placed on the upper surface of the platen 13. The platen 13 determines a distance between the recording medium M and the discharge surface 33*a* of the head 30 which is arranged to face the recording medium M.

Figure 3:
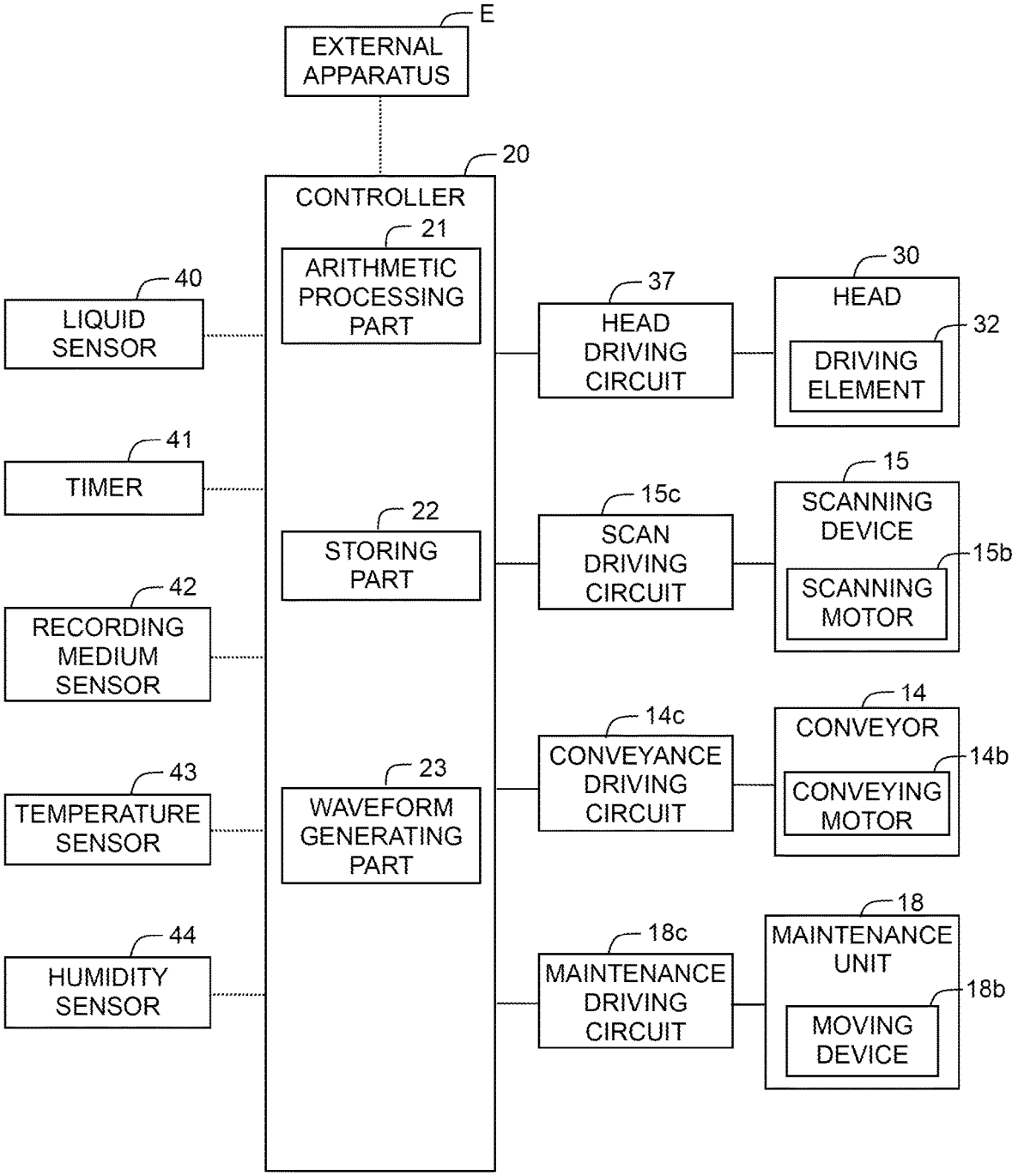
FIG. 3 is a functional block diagram depicting the configuration of the liquid discharging apparatus of FIG. 1.

The conveying device 14 has, for example, two conveying rollers 14*a*, and a conveying motor 14*b* (FIG. 3). The two conveying rollers 14*a* sandwich the platen 13 therebetween in the front-rear direction, and are arranged parallel to each other so that rotational axes thereof extend in the left-right direction. The two conveying rollers 14*a* are connected to the conveying motor 14*b*, are rotated in a case that the conveying motor 14*b* is driven, and convey the recording medium M rearward on the platen 13.

The scanning device 15 has, for example, two guide rails 15*a*, a scanning motor 15*b* (FIG. 3), an endless belt, etc. Each of the two guide rails 15*a* extends in the left-right direction over a range between the flushing area A and the maintenance area C. The carriage 12*a* of the head unit 12 is supported by the two guide rails 15*a*, and is fixed to the endless belt. The endless belt is connected to the scanning motor 15*b* via a pulley, and runs in accordance with the driving of the scanning motor 15*b*. With this, the carriage 12*a* moves reciprocally in the left-right direction along the two guide rails 15*a*, and the head 30 moves between the flushing area A and the maintenance area C via the recording area B.

The storing tank 16 is, for example, a cartridge which is detachable and attachable with respect to the casing 11, and is provided as a plurality of storing tanks 16 for respective kinds of the liquid. For example, there are provided four storing tanks 16 and store liquids of black, yellow, cyan and magenta, respectively. Each of the storing tanks 16 is connected to the plurality of liquid channels of the head 30 by a tube 16*a*, and supplies the liquid to the plurality of nozzles 31 of a nozzle array included in the plurality of nozzle arrays and corresponding thereto.

The receiving part 17 is arranged in the flushing area A, and receives the liquid(s) discharged from the head 30 by a flushing processing. The specific of the receiving part 17 will be described later on.

The maintenance unit 18 is arranged in the maintenance area C, and has a cap 18*a* and a moving device 18*b* (FIG. 3). The cap 18*a* has, for example, a shape of rectangular parallelepiped which has a recessed part and which is opened to the upper side. The moving device 18*b* moves the cap 18*b* between a capping position at which the cap 18*a* covers the discharge surface 33*a* and an uncapping position at which the cap 18*a* is separated from the discharge surface 33*a*. The moving device 18 includes, for example, a motor, etc., and moves the cap 18*a* upward and downward between the capping position and the uncapping position.

The uncapping position is, for example, located below the capping position. At the uncapping position, the cap 18*a* is separated or away from the discharge surface 33*a* and allows the discharge surface 33*a* to be exposed, and the opening of the cap 18*a* faces the discharge surface 33*a* of the head 30 arranged in the maintenance area C. Further, at the capping position, the cap 18*a* approaches closely to the discharge surface 33*a* and covers the discharge surface 33*a*. With this, it is possible to prevent the liquid from drying from the openings of the plurality of nozzles 31 formed in the discharge surface 33*a*.

Configuration of Head

The head 30 has the plurality of driving elements 32, the channel forming body 33 and a vibration plate 34. As depicted in FIG. 2, the channel forming body 33 is a stacked body of a plurality of plates, and holes and grooves which are various in sizes are formed in the plates, respectively. In the stacked boy in which the respective plates are stack on one another, the holes and the grooves are combined to thereby form a plurality of liquid channels. The plurality of liquid channels have the plurality of nozzles 31, and a supply channel supplying the liquid to the plurality of nozzles 31. The supply channel includes a plurality of individual channels 35 and a plurality of manifolds 36.

Each of the plurality of nozzles 31 is opened in the discharge surface 33*a* of the channel forming body 33. Each of the plurality of manifolds 36 extends in the front-rear direction, and has a supply port at an end thereof. The supply port is connected to a storing tank 16 (FIG. 1) corresponding thereto by the tube 16*a* (FIG. 1), etc. Each of the plurality of individual channels 35 extends from the manifold 36 and arrives at one of the plurality of nozzles 31 corresponding thereto. A throttle channel 35*a*, a pressure chamber 35*b* and a communicating channel 35*c* are present between the manifold 36 and one of the plurality of nozzles 31 corresponding thereto, and these elements 36, 35*a*, 35*b*, 35*c* and 31 are connected in this order. Namely, each of the plurality of pressure chambers 35*a* is communicated with one of the plurality of nozzles 31.

In such a configuration, the liquid of each of the kinds flows from the storing tank 16 corresponding thereto, passes through the tube 16*a*, etc., and flows into the manifold 36 corresponding thereto via the supply port. While the liquid is flowing through the manifold 36, the liquid flows into each of the plurality of individual channels 35. Then, in each of the plurality of individual channels 35, the liquid flows in the throttle channel 35*a*, the pressure chamber 35*b* and the communicating channel 35*c* in this order, and is supplied to the nozzle 31.

The vibration plate 34 is arranged on the channel forming body 33, and covers an upper side opening of the pressure chamber 35*b*. Each of the plurality of driving elements 32 is, for example, a piezoelectric element, is arranged on the vibration plate 34 at a part thereof which is located above the pressure chamber 35*b*, and is connected to the controller 20 (FIG. 1). Each of the plurality of driving elements 32 expands and contracts in a case that a driving signal from the controller 20 is applied to each of the plurality of driving elements 32. In accordance with this, the vibration plate 34 is deformed so as to change the volume of the pressure chamber 35*b*. With this, a pressure is applied to the liquid in the pressure chamber 35*b*, thereby discharging or ejecting the liquid from the nozzle 31.

Configuration of Receiving Part

Figure 2B:
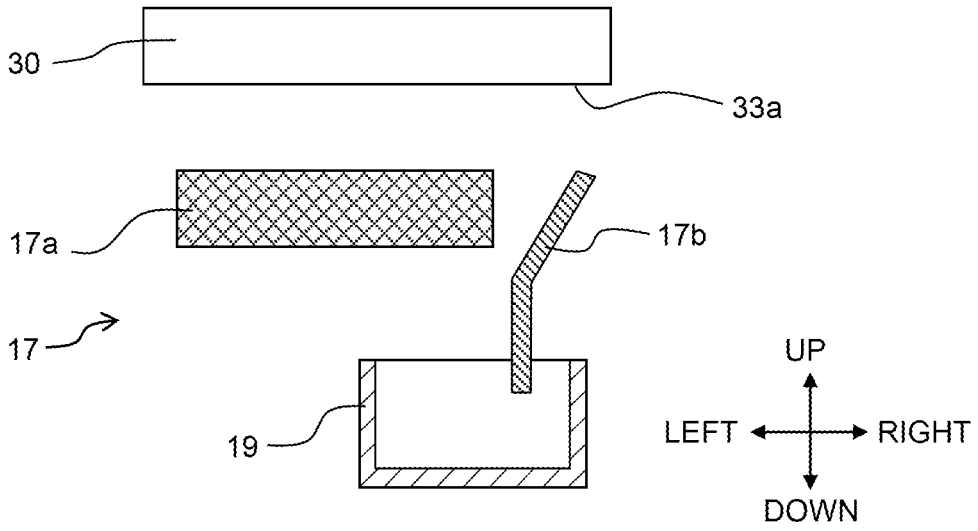
FIG. 2B is a schematic view of a receiving part of FIG. 1, as seen from the front.

As depicted in FIG. 2B, the receiving part 17 has an absorbing body 17*a* and a guide 17*b*. The absorbing body 17*a* and the guide 17*b* are arranged side by side in the left-right direction, and the guide 17*b* is arranged closely to (on the right side) with respect to the recording area B, as compared with the absorbing body 17*a*. In the left-right direction, the sizes of the absorbing body 17*a* and the guide 17*b*, respectively, are same or longer than the length in a formation range of the plurality of nozzles 31. The absorbing body 17*a* may be formed, for example, of a porous body which absorbs the liquid, and may be accommodated in a container of which upper part is opened. Note that the receiving part 17 may be either one of the absorbing body 17*a* and the guide member 17*b*. Alternatively, the receiving part 17 may have a container of which upper part is opened, instead of having the absorbing body 17*a*.

The guide 17*b* has, for example, a shape of a flat plate which is bent, extends in the front-rear direction; in the guide member 17*b*, a lower part from a lower end up to an intermediate part extends in the vertical direction, and an upper part from the intermediate part up to an upper end is inclined upwardly toward the side of the recording area B (right side). Accordingly, among the upper part of the guide member 17*b*, an inclined surface on the side of the absorbing body 17*a* (left side) is inclined with respect to the discharge surface 33*a* of the head 30 so that a spacing distance from the absorbing body 17*a* becomes wider in an upward direction. The inclined surface maybe a flat surface which is inclined at a constant angle, or may be a curved surface which is curved. Further, the inclined surface has a coating, such as a fluorine coating, etc., applied thereon, and has a water repellency.

A discarded liquid tank 19 is arranged at a position below the guide 17*b*. The lower part of the guide 17*b* extends into the discarded liquid tank 19. A part of the liquid discharged from the plurality of nozzles 31 of the discharge surface 33*a* by the flushing processing lands on the absorbing body 17*a* and is absorbed thereby, and a remaining part of the liquid lands on the inclined surface of the guide 17*b*, slides downward on the inclined surface and is accommodated in the discarded liquid tank 19.

Configuration of Controller

As depicted in FIG. 3, the controller 20 has an arithmetic processing part 21, a storing part 22 and a waveform generating part 23. The controller 20 is connected to an external apparatus E such as a computer, a network, etc., and receives a variety of kinds of data such as print data, etc., from the external apparatus E. The print data includes data for printing an image on the recording medium M.

The storing part 22 is accessible by the arithmetic processing part 21 and is constructed of a RAM and a ROM, etc. The RAM stores the variety of kinds of data temporarily. Print data, and data converted by the arithmetic processing part 21 are exemplified as the variety of kinds of data. The ROM stores a program for performing a variety of kinds of data processing. Note that the program may be obtained from the external apparatus E, or may be stored in another recording medium.

The arithmetic processing part 21 is constructed of a processor such as a CPU, and an integrated circuit such as ASIC, etc. The arithmetic processing part 21 executes a program stored in the ROM to thereby control each of the plurality of driving elements 32, the scanning motor 15*b*, the conveying motor 14*b* and the moving device 18 so as to perform the variety of kinds of processing. For example, the controller 20 executes a printing processing, a recording processing, a first determining processing and a flushing processing (a pre-recording flushing processing, a first flushing processing, a second flushing processing). These processings will be described later on.

The waveform generating part 23 generates a waveform signal defining a waveform of a driving signal outputted to each of the plurality of driving element 32. The waveform generating part 23 may be a dedicated circuit, or may be constructed of the arithmetic processing part 21 and the storing part 22. The waveform signal is, for example, a pulse signal and includes a plurality of kinds of waveform signals which are mutually different in an amount of a liquid droplet discharged from the nozzle 31. The plurality of kinds of waveform signals have a discharging waveform signal by which the liquid is discharged from the nozzle 31, and a non-discharging waveform signal by which the meniscus of an opening of the nozzle 31 is vibrated so as not to discharge the liquid droplet. The discharging waveform signal includes, for example, an intermediate drop waveform signal by which a liquid droplet of a predetermined amount (intermediate drop) is discharged, a small drop waveform signal by which a liquid droplet of an amount smaller than the predetermined amount (small drop) is discharged, and a large drop waveform signal by which a liquid droplet of an amount greater than the predetermined amount (large drop) is discharged.

The arithmetic processing part 21 selects, based on the print data, one kind of the waveform signal among the plurality of kinds of waveform signals for each of the plurality of nozzles 31 and at each driving cycle, and generates waveform signal selecting data. While doing so, the arithmetic processing part 21 generates waveform selecting data for printing (printing-waveform selecting data), depending on a liquid droplet amount for each one of drops based on the print data.

Further, the arithmetic processing part 21 generates waveform selecting data for flushing (flushing-waveform selecting data) for the flushing processing. By the flushing-waveform selecting data, a predetermined discharging waveform signal, for example, the large drop waveform signal of which liquid discharge amount is the greatest is selected. Note that the flushing-waveform signal of which liquid discharging amount is greater than that of a waveform signal for printing (printing-waveform signal) may be further included in the discharging waveform signal; the flushing-waveform signal may be selected by the flushing-waveform selecting data.

The controller 20 is connected to a head driving circuit 37, and the head driving circuit 37 is connected to the plurality of driving elements 32. Accordingly, the controller 20 outputs the waveform signal and the waveform selecting data to the head driving circuit 37. The head driving circuit 37 generates the driving signal of each of the plurality of driving elements 32, from the waveform signal and the waveform selecting data, and the head driving circuit 37 outputs the generated driving signal to each of the plurality of driving elements 32.

With this, each of the plurality of driving elements 32 is driven in accordance with the driving signal, which in turn changes the volume of the pressure chamber 35*b* in the liquid channel corresponding thereto, thereby applying pressure to the liquid in the pressure chamber 35*b*. In a case that the non-discharging driving signal is outputted, the meniscus in the opening of the nozzle 31 communicating with the pressure chamber 35*b* is vibrated so as not to discharge the liquid from the nozzle 31. Further, in a case that the driving signal based on the flushing-waveform selecting data is outputted, a liquid droplet of the maximum amount is discharged from the nozzle 31. Furthermore, in a case that the driving signal based on the printing-waveform selecting data is outputted, a liquid droplet of the amount in accordance with the print data is discharged from the nozzle 31.

Moreover, the controller 20 is connected to the scanning motor 15*b* via a scan driving circuit 15*c*, and is connected to the conveying motor 14*b* via a conveyance driving circuit 14*c*. The controller 20 controls the driving of the scanning motor 15*b* by the scan driving circuit 15*c*, based on the print data. The controller 20 controls the driving of the conveying motor 14*b* by the conveyance driving circuit 14*c*, based on the print data. With this, the driving timing, the rotation speed, the rotation amount, etc., of each of the scanning motor 15*b* and the conveying motor 14*b* are controlled.

Further, the controller 20 is connected to the moving device 18*b* via a maintenance driving circuit 18*c*. The controller 20 controls the driving of the moving device 18*b* by the maintenance driving circuit 18*c*, based on print instruction by obtainment of the print data. With this, in a case that the printing processing is started, the moving device 18*b* moves the cap 18*a* from the capping position to the uncapping position. Further, in a case that the printing processing is finished, the moving device 18*b* moves the cap 18*a* from the uncapping position to the capping position.

Printing Processing

In a case that the controller 20 obtains the print data, the printing processing is started. In the printing processing, a scanning operation of moving the head 30 in the left-right direction, a discharging operation of discharging the liquid from the nozzles 31 to the recording medium M, a conveying operation of conveying the recording medium M rearward with a predetermined distance, a first determining processing and a flushing processing are performed based on the print data. Further, in the printing processing, the recording processing of performing the discharging operation together with the scanning operation is performed. The recording processing and the conveying processing are alternately repeated, thereby recording an image on the recording medium M, and advancing the printing processing.

Figure 4A:
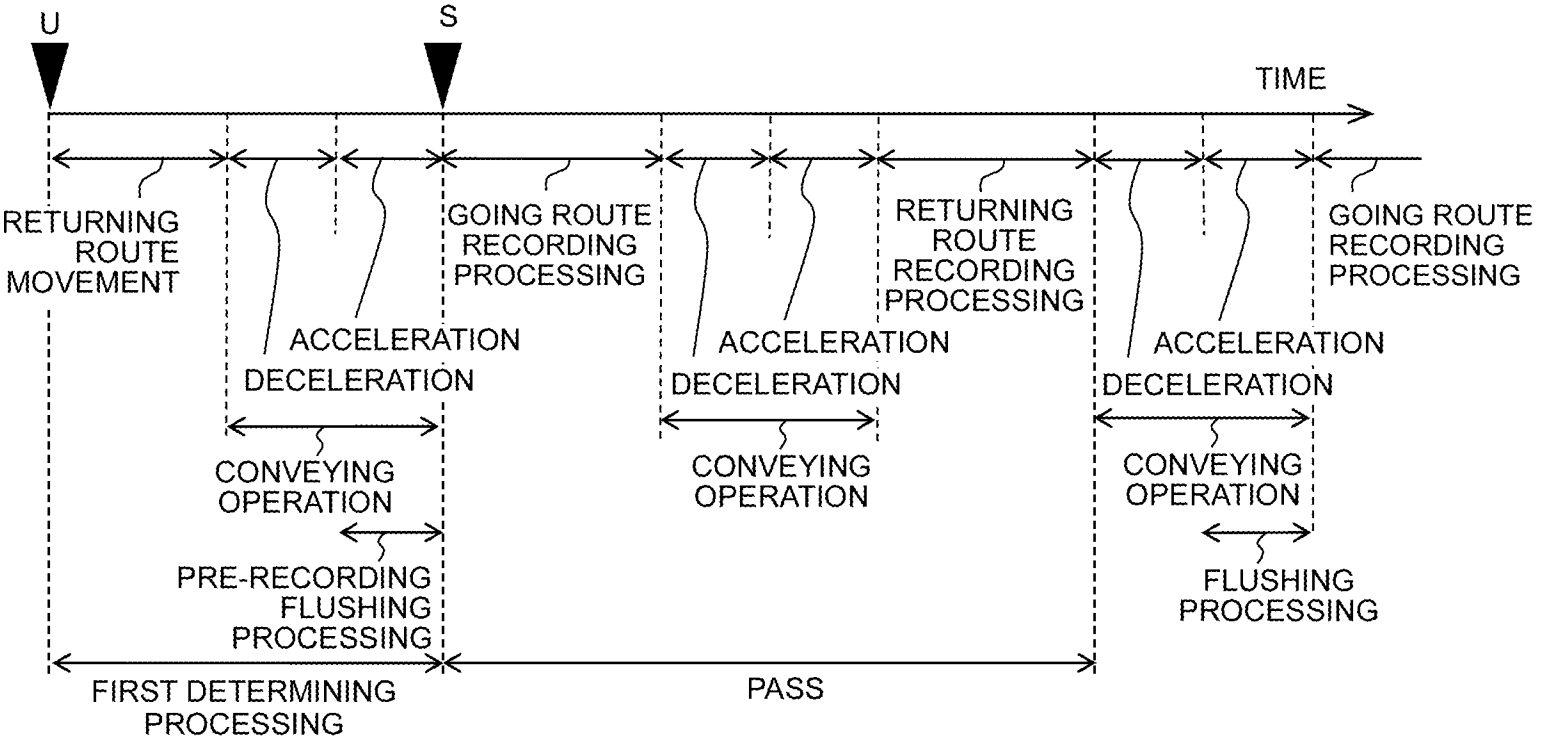
FIG. 4A is a view depicting a printing processing.

For example, as depicted in FIG. 4A, in a case that the uncapping of the head 30 is performed in the maintenance area C, a returning (backward) route movement in which the head 30 moves from the maintenance area C leftward in the recording area B toward the flushing area A is performed. Subsequently, the head 30 decelerates while moving in the flushing area A leftward and turns back at a left end of the flushing area A, and the head 30 accelerates while moving in the flushing area A rightward. During the scanning operation of the deceleration and acceleration, the conveying operation is performed.

During the acceleration, the head 30 moves at a location above the receiving part 17, and the pre-recording flushing is performed during this period of time. Here, the controller 20 counts (measures) an elapsed time elapsed since the pre-recording flushing processing, based on a clock signal, etc. Further, the first determining processing is executed, based on the print data, in a period of time since the start of the printing processing and until the end of the recording processing, and a flushing interval is set depending on a result of the determination in the first determining processing.

Subsequent to the pre-recording flushing processing, the recording processing (going (forward) route recording processing) is performed. In the recording processing, the head 30 performs the discharging operation based on the print data while moving from the flushing area A rightward in the recording area B toward the maintenance area C. Subsequently, the head 30 decelerates while moving in the maintenance C rightward and turns back at a right end of the maintenance area C, and then the head 30 accelerates while moving in the maintenance area C leftward. During the scanning operation of the deceleration and acceleration, the conveying operation is performed.

Further, the recording processing (returning (backward) route recording processing) in which the head 30 performs the discharging operation based on the print data while moving from the maintenance area C leftward in the recording area B toward the flushing area A is performed. Then, in a case that the head 30 reaches the flushing area A, it is possible to perform the flushing processing, and thus the controller 20 determines as to whether or not the elapsed time elapsed since the pre-recording flushing processing has reached the flushing interval. Then, in a case that the elapsed time has reached the flushing interval, the flushing processing is executed while the head 30 accelerates as the head 30 is moving rightward in the flushing area A. Further, the controller 20 counts or measures an elapsed time elapsed since the flushing processing.

Such a measurement (counting) of the elapse time elapsed since the executed flushing processing and such a determination as to whether or not the elapsed time has reached the flushing interval are executed every time the head 30 reaches the flushing area A. Provided that the going (forward) route recording processing and the returning (backward) route recording processing are defined as one pass, the measurement of the elapsed time and the determination are performed for each pass. Further, it is allowable that the flushing processing is performed while the head 30 is decelerating in the maintenance area C.

Recording Processing, First Determining Processing

The controller 20 executes the recording processing of discharging or ejecting the liquid from the plurality of nozzles 31 based on the print data. Further, the controller 20 executes, based on the print data, a first determining processing of determining whether the recording processing is to be executed in a first mode or in a second mode in which a processing speed is faster than that in the first mode.

For example, the first mode is a high image quality printing mode in which the image quality is prioritized than in the second mode, and the printing speed is slower than that in the second mode. The second mode is a high-speed printing mode in which the printing speed is prioritized than in the first mode, and the printing speed is faster than that in the first mode. Accordingly, the controller 20 controls the moving speed of the head 30 by the scan driving circuit 15*c* so that the moving speed of the head 30 is faster in the recording processing in the second mode than that in the recording processing in the first mode.

Further, the print data includes a printing condition, and the controller 20 executes the first determining processing based on the printing condition. For example, the printing condition may be a printing mode which is inputted to the controller 20 by a user using an input device. In such a case, the controller 20 determines the mode of the recording processing to be the first mode in a case that the printing condition is the high image quality printing mode. Alternatively, the controller 20 determines the mode of the recording processing to be the second mode in a case that the printing condition is the high-speed printing mode.

Furthermore, the printing condition may be a kind of the recoding medium M. The kind is exemplified, for example, by a plain paper (regular paper) such as a PPC paper, etc., and a high image quality paper such as high quality paper, glossy paper (coated paper), etc., on which the reproducibility of a printed image is superior than that on the plain paper. The kind may be information inputted to the controller 20 by the user using the input device, or information detected by a sensor provided on the liquid discharging apparatus 10 and inputted to the controller 20. In a case that the kind is the high image quality paper, the controller 20 determines the mode of the recording processing to be the first mode. In a case that the kind is the plain paper, the controller 20 determines the kind of the recording mode to be the second mode.

Flushing Processing

The controller 20 executes the pre-printing flushing processing of discharging the liquid from the plurality of nozzles 31 to the receiving part 17, after the uncapping of the cap 18*a* and before the recording processing. The controller 20 executes a first flushing processing of discharging the liquid from the nozzles 31 to the receiving part 17, in the recording processing. The controller 20 executes a second flushing processing of discharging the liquid from the nozzles 31 to the receiving part 17, the second flushing processing being executed after the execution of the first flushing processing and in the recording processing. In a case that the controller 20 determines, by the first determining processing, that the recording processing is to be executed in the second mode, the controller 20 makes a first flushing interval between the pre-recording flushing processing and the first flushing processing to be longer than a second flushing interval between the first flushing processing and the second flushing processing.

Specifically, in the flushing processing, the controller 20 drives the plurality of driving elements 32 so that the liquid discharged from the plurality of nozzles 31 enters into the receiving part 17 while the controller 20 is moving the head 30 in the flushing area A. By this driving of the plurality of driving elements 32, the pressure is applied to the liquid in the plurality of nozzles 31, and the liquid is discharged from the plurality of nozzles 31 and enters into the receiving part 17. In one time of the flushing processing, the discharging operation of the liquid is performed for a predetermined number of times (for example, 50 times). Since the liquid is discharged from the plurality of nozzles 31 by the flushing processing in such a manner, it is possible to lower the occurrence of any unsatisfactory discharge due to the increase in the viscosity of the liquid.

Figure 4B:
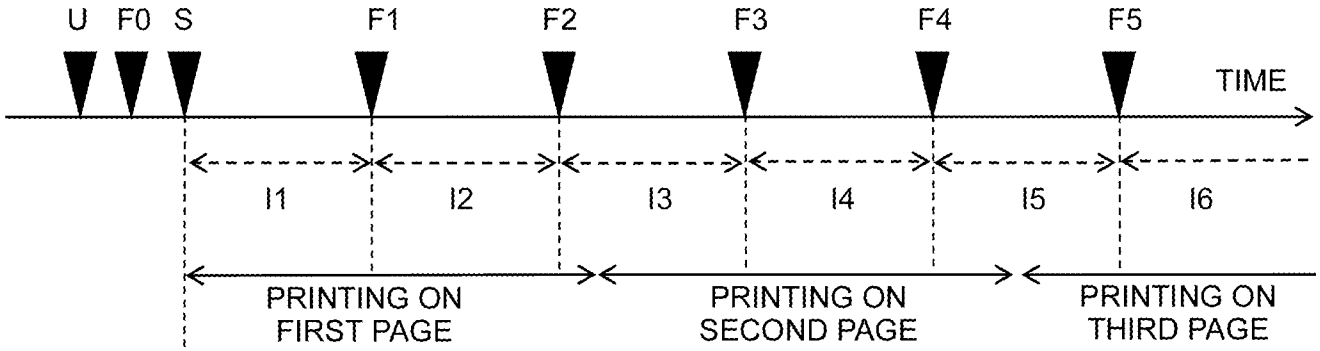
FIG. 4B is a view depicting a flushing interval of a first pattern.
Figure 4C:
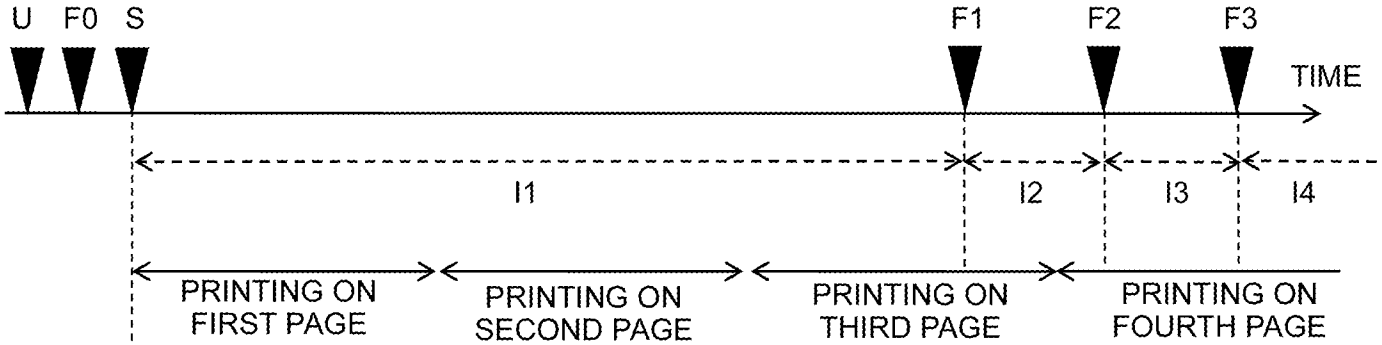
FIG. 4C is a view depicting a flushing interval of a second pattern.

The flushing processing is performed in the printing processing, and has the pre-recording flushing processing and the flushing processing. As depicted in FIGS. 4A to 4C, the printing processing has a plurality of recording processings from the start to the end thereof. A pre-recording flushing processing F0 is performed after uncapping U of the cap 18*a* and before start S of a first recording processing included in the plurality of recording processings. The flushing processing is performed between two successive recording processings among the plurality of recording processings, and includes a first flushing processing F1 and a second flushing processing F2. The first flushing processing F1 is a flushing processing which is executed next to the pre-recording flushing processing F0, and the second flushing processing F2 is a flushing processing executed next to the first flushing processing F1.

Accordingly, the pre-recording flushing processing F0, the first flushing processing F1 and the second flushing processing F2 are performed in this order. The recording processing is performed in a first flushing interval I1 between the pre-recording flushing processing F0 and the first flushing processing F1, and in a second flushing interval I2 between the first flushing processing F1 and the second flushing processing F2.

As depicted in FIG. 4B, a flushing interval of a first pattern is used in the recording processing in the first mode. In the flushing interval of the first pattern, the first flushing interval I1 and the second flushing interval I2 are equal to each other. For example, a (n)th flushing interval In between a (n−1)th flushing processing Fn−1 and a (n)th flushing processing Fn is equal to the first flushing interval I1. The "n" in this case is an integer of not less than 2 (two). In the example depicted in FIG. 4B, the flushing processing is performed at an equal interval (for example, 10 seconds) in all the printing processings from 1st page to 3rd page.

As depicted in FIG. 4C, a flushing interval of a second pattern is used in the recording processing in the second mode. In the flushing interval of the second pattern, the first flushing interval I1 is longer than the second flushing interval I2. For example, although (n)th flushing intervals In after the second flushing interval I2 and thereafter are equal to each other, but are shorter than the first flushing interval I1. Further, the first flushing interval I1 of the second pattern is longer than the first flushing interval I1 of the first pattern. For example, in the second pattern, the first flushing pattern I1 is 60 seconds, and the (n)th flushing interval In is 10 seconds. In the example depicted in FIG. 4C, an image is recorded by the recording processings from the first to third pages, during 60 seconds since the pre-recording flushing processing F0, without executing the flushing processing. Then, the first flushing processing F1 is executed in the recording processing for the third page; after that, the (n)th flushing processing is executed at every 10 seconds.

Method of Controlling Liquid Discharging Apparatus

Before the controller 20 obtains the print data, the head 30 is arranged in the maintenance area C, and the cap 18*a* is arranged at the capping position. Accordingly, the discharge surface 33*a* is covered by the cap 18*a*, and the liquid inside the plurality of nozzles 33 which are opened in the discharge surface 33*a* is prevented from being dried.

Figure 5:
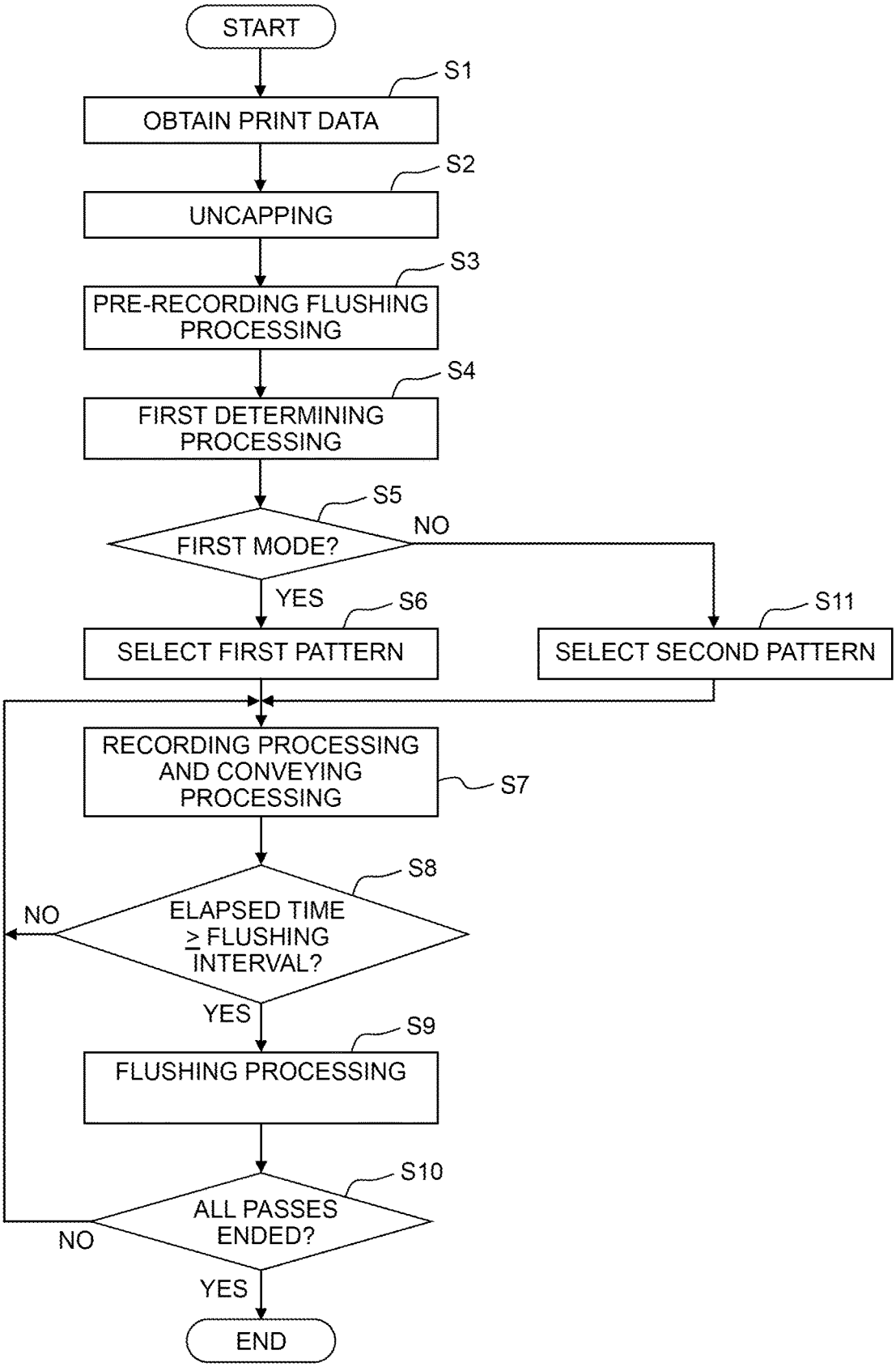
FIG. 5 is a flow chart indicating an example of a method of controlling the liquid discharging apparatus of FIG. 1.

As depicted in FIG. 5, in a case that the controller 20 obtains the print data (step S1), the controller 20 starts the printing processing. Accordingly, the controller 20 lowers, by the moving device 18*b*, the cap 18*a* from the capping position to the uncapping position. With this, the uncapping of the cap 18*a* is performed (step S2), and the discharge surface 33*a* is exposed.

Then, the controller 20 moves, by the returning route movement, the head 30 to the flushing area A. In the flushing area A, the controller 20 executes the pre-printing flushing processing F0, by driving the plurality of driving elements 32 (step S3). With this, the liquid is discharged from the plurality of nozzles 31, thereby making it possible to lower the occurrence of any unsatisfactory discharge due to the increase in the viscosity of the liquid. Further, the controller 20 counts or measures the elapsed time elapsed since the pre-recording flushing processing F0.

Next, the controller 20 executes the first determining processing (step S4). In a case that the mode of the recording processing is determined to be the first mode, as the result of the first determining processing (step S5: YES), the controller 20 selects the flushing interval of the first pattern (step S6). Then, the controller 20 executes the recording processing and the conveying processing (step S7).

When the head 30 arrives at the maintenance area C from the recording area B, the controller 20 determines whether the elapsed time elapsed since the pre-printing flushing processing F0 is not less than the first flushing interval I1 of the first pattern (step S8). Here, in a case that the elapsed time is less than the first flushing interval I1 (step S8: NO), the controller 20 continues the execution of the recording processing and the conveying processing (step S7). On the other hand, in a case that the elapsed time is not less than the first flushing interval I1 (step S8: YES), the controller 20 executes the first flushing processing (step S9).

With this, even in a case that the liquid inside the plurality of nozzles 31 is dried during the recording processing and the conveying processing, the liquid is discharged from the plurality of nozzles 31 by the first flushing processing, and thus it is possible to lower the occurrence of any unsatisfactory discharge due to the increase in the viscosity of the liquid. Further, since the first flushing interval I1 of the first pattern is shorter than the first flushing interval I1 of the second pattern, the time of the printing processing of the first mode becomes to be longer than that the time of the printing processing of the second mode. However, the number of times of the flushing processing of the first mode is greater than the number of times of the flushing processing of the second mode, and thus the occurrence of any unsatisfactory discharge due to the increase in the viscosity of the liquid can be lowered by the flushing processing. Accordingly, it is possible to perform the printing conforming to the purpose of the first mode in which the high image quality is prioritized.

Further, the controller 20 counts or measures an elapsed time elapsed since the first flushing processing F1. Then, the controller 20 returns to the processing of step S7, unless all the printing processings are executed with respect to all the passes, and repeats the processings from step S7 to step S10 with respect to the remaining passes.

In this situation, in a case that the controller 20 executes the flushing processing, the controller 20 counts or measures the elapsed time elapsed since this flushing processing. Every time the head 30 reaches the maintenance area C, the controller 20 determines whether or not an elapsed time elapsed since a flushing processing executed the last time (last-time flushing processing) is not less than the (n)th flushing interval In of the first pattern (step S8). In a case that the elapse time is not less than the (n)th flushing interval In of the first pattern (step S8: YES), the controller 20 executes the (n+1)th flushing processing (step S9). Then, in a case that the recoding processings are executed for all the passes (step S10: YES), the controller 20 ends the printing processing.

On the other hand, in a case that the mode of the recording processing is determined to be the second mode, as the result of the first determining processing of step S4 (step S5: NO), the controller 20 selects the flushing interval of the second pattern (step S11). The first flushing interval I1 of the second pattern is longer than the first flushing interval I1 of the first pattern and the second flushing interval I2 of the second pattern. Then, the controller 20 executes the processings of step S7 and thereafter. In such a manner, in the second pattern, the first flushing interval I1 is made to be longer than the second flushing interval I2. With this, it is possible to reduce the number of times of the flushing processing and the time required for executing the flushing processing, thereby making it to possible to perform a high-speed printing conforming to the purpose of the second mode in which the printing speed is fast. Further, it is also possible to lower, by the flushing processing, the occurrence of any unsatisfactory discharge due to the increase in the viscosity of the liquid.

Second Embodiment

A liquid discharging apparatus 10 according to a second embodiment of the present disclosure is provided, in the first embodiment, with a liquid sensor 40 configured to detect the kind of the liquid, as depicted in FIG. 3. The controller 20 executes a second determining processing of determining whether the kind of the liquid is a predetermined kind. In a case that the controller 20 determines, by the second determining processing, that the kind is not the predetermined kind, the controller 20 makes the first flushing interval to be shorter than that in a case that the controller 20 determines that the kind is the predetermined kind.

Specifically, the liquid sensor 40 is a sensor which is configured to detect the kind of the liquid directly or indirectly, which is connected to the controller 20 and which outputs detection information to the controller 20. In the following, although an explanation will be given about a liquid sensor 40 configured to detect the kind of the liquid indirectly, it is allowable to use a liquid sensor 40, which is configured to detect the kind of the liquid directly, in the second determining processing.

As the liquid sensor 40, for example, an identifying sensor configured to identify the kind of the storing tank 16 is used. In this case, an ID tag is attached to the storing tank 16. The ID tag is an IC tag of the passive type, such as an RFID tag, etc., and identification information of the storing tank 16 is previously recorded in the ID tag. The liquid sensor 40 is an ID reader such as an RFID reader, etc., reads the identification information from the ID tag, and outputs the read identification information of the storing tank 16 to the controller 20.

In the second determining processing, in a case that the information outputted from the liquid sensor 40 is predetermined identification information which is previously stored in the storing part 22, the controller 20 determines that the liquid stored in the storing tank 16 is a liquid of the predetermined kind. On the other hand, in a case that the information outputted from the liquid sensor 40 is not the predetermined identification information, the controller 20 determines that the liquid stored in the storing tank 16 is not the liquid of the predetermined kind.

Further, it is allowable that a liquid amount sensor configured to detect the liquid amount of the storing tank 16 is used as the liquid sensor 40. The liquid amount sensor detects the liquid amount inside the storing tank 16, and outputs the detected liquid amount to the controller 20. In the second determining processing, in a case that the storing tank 16 has not been exchanged and that the liquid amount of the storing tank 16 is increased, the controller 20 determines that the liquid is added to the storing tank 16 and that the liquid stored in the storing tank 16 is not the liquid of the predetermined kind. On the other hand, in a case that the storing tank 16 has not been exchanged and that the liquid amount of the storing tank is not increased, the controller 20 determines that the liquid stored in the storing tank 16 is the liquid of the predetermined kind.

Figure 6:
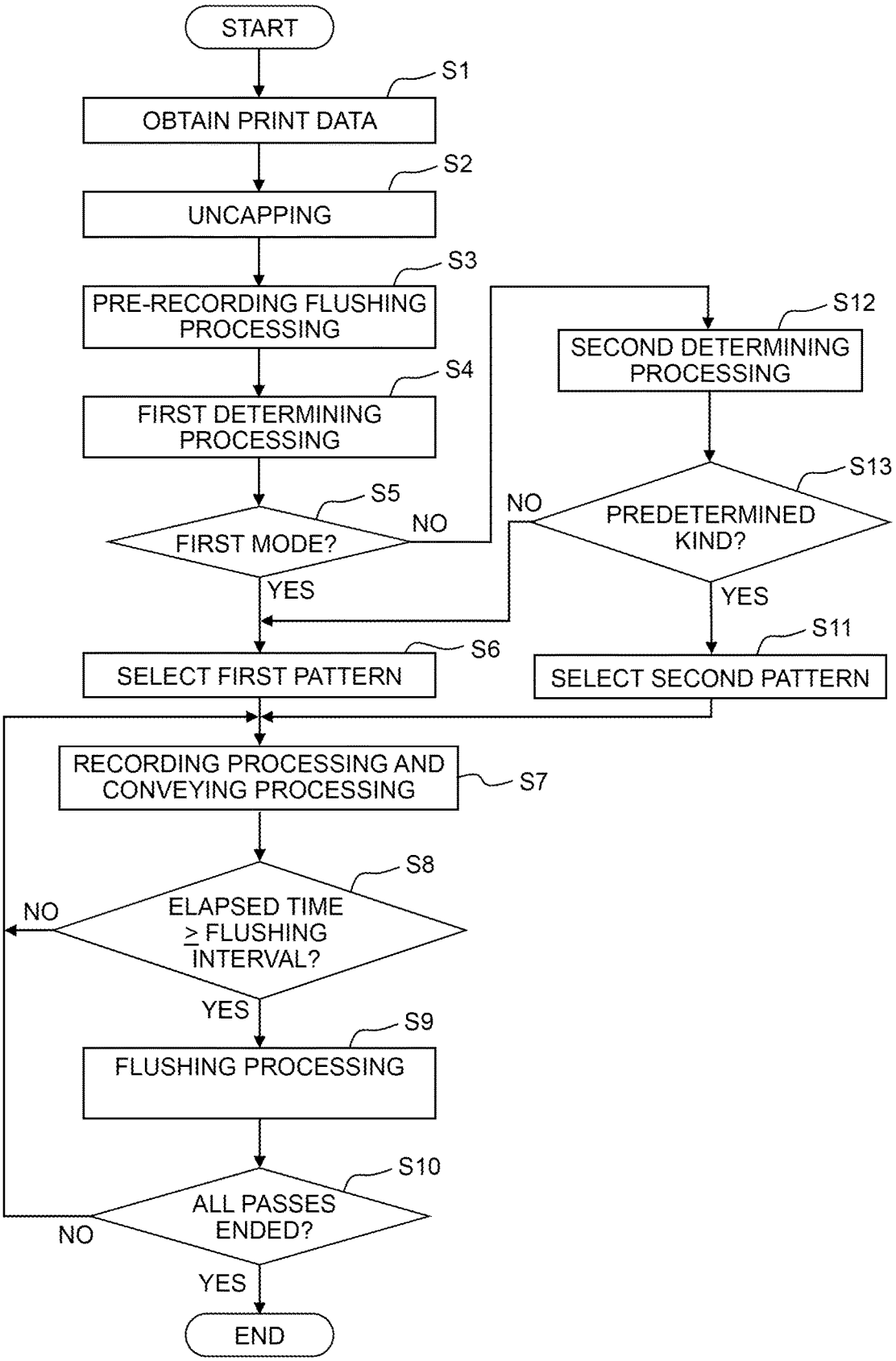
FIG. 6 is a flow chart indicating an example of a method of controlling the liquid discharging apparatus, according to a second embodiment of the present disclosure.

In a flow chart of a method of controlling the liquid discharging apparatus 10 as depicted in FIG. 6, the controller 20 executes processings of step S12 and step S13 between step S5 and step S11 in the flow chart depicted in FIG. 5. In a case that the controller 20 determines, by the first determining processing, that the recording processing is to be executed in the second mode (step S5: NO), the controller 20 executes the second determining processing in step S12.

In a case that the controller 20 determines, by the second determining processing, that the kind of the liquid is the predetermined kind (step S13: YES), the controller 20 selects the flushing interval of the second pattern (step S11). On the other hand, in a case that the controller 20 determines, by the second determining processing, that the kind of the liquid is not the predetermined kind (step S13: NO), the controller 20 selects the flushing interval of the first pattern (step S6). The first flushing interval I1 of the second pattern is longer than the first flushing interval I1 of the first pattern and the second flushing interval I2 of the second pattern.

In such a manner, with respect to the liquid of the predetermined kind, the evaporation rate, etc., of the liquid is already known. Accordingly, even in a case of selecting the second pattern in which the first flushing interval is long, it is possible to avoid such a situation that the liquid is dried to a greater extent than expected and that any unsatisfactory discharge occurs. In contrast, in a case that the liquid is not of the predetermined kind, there is such a possibility that the liquid might be dried to a greater extent than expected and that any unsatisfactory discharge might occur. Therefore, the first pattern in which the first flushing interval is shorter than that in the second pattern is selected. With this, it is possible to lower any unsatisfactory discharge due to the increase in the viscosity of the liquid.

Third Embodiment

A liquid discharging apparatus 10 according to a third embodiment of the present disclosure is provided with a timer 41 configured to count or measure use time of the head 30, in the first or second embodiment as depicted in FIG. 3. The controller 20 executes a third determining processing of determining whether the use time is not less than a predetermined period. In a case that the controller 20 determines, by the third determining processing, that the use time is not less than the predetermined period, the controller 20 makes the first flushing interval to be shorter than in a case that the controller 20 determines that the use time is less than the predetermined period.

Specifically, the timer 41 may be constructed of the controller 20, or may be a device different from the controller 20. The timer 41 counts a start of use of the liquid discharging apparatus 10 or the head 30 and an exchange of the head 30, etc., as a use start timing of the head 30, and measures an elapsed time since the use start timing based on a clock signal, etc., as the use time of the head 30. For example, in a case that the timer 41 is constructed of the controller 20, the controller 20 periodically adds a numerical value to a predetermined area of the storing part 22, based on the clock signal. In this case, the numerical value stored in the storing part 22 may be defined as the use time of the head 30.

Figure 7:
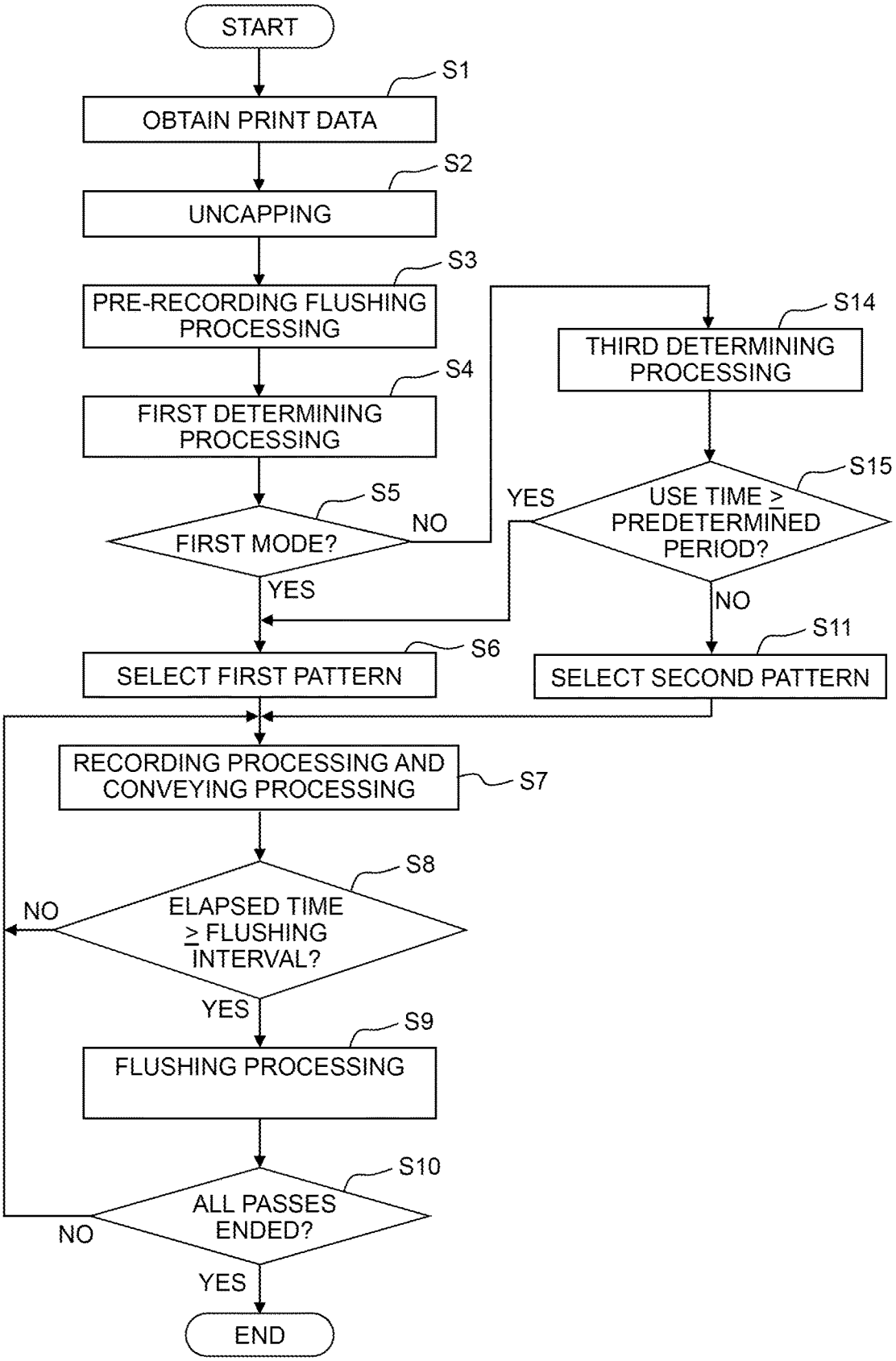
FIG. 7 is a flow chart indicating an example of a method of controlling the liquid discharging apparatus, according to a third embodiment of the present disclosure.

In a flow chart of a method of controlling the liquid discharging apparatus 10 as depicted in FIG. 7, the controller 20 executes processings of step S14 and step S15 between step S5 and step S11 in the flow chart depicted in FIG. 5. In a case that the controller 20 determines, by the first determining processing, that the recording processing is to be executed in the second mode (step S5: NO), the controller 20 executes the third determining processing in step S14. In the third determining processing, the controller 20 determines whether or not the use time measured by the timer 41 is equal to or more than a predetermined period.

In step S15, in a case that the controller 20 determines, by the third determining processing, that the use time is less than the predetermined period (step S15: NO), the controller 20 selects the flushing interval of the second pattern (step S11). On the other hand, in a case that the controller 20 determines, by the third determining processing, that the use time is equal to or more than the predetermined period (step S15: YES), the controller 20 selects the flushing interval of the first pattern (step S6).

In such a manner, as the use time of the head 30 becomes longer, any unsatisfactory discharge of the liquid is likely to occur. Accordingly, in a case that the use time is not less than the predetermined use time, the first pattern is selected to thereby make the first flushing interval to be shorter than the first flushing interval in the second pattern, thereby making it possible to lower the occurrence of any unsatisfactory discharge due to the increase in the viscosity of the liquid. On the other hand, in a case that the use time of the head 30 is less than the predetermined use time, the second pattern is selected to thereby make it possible to perform a high-speed printing.

Fourth Embodiment

A liquid discharging apparatus 10 according to a fourth embodiment of the present disclosure is provided with a conveying device 14 configured to convey the recoding medium M at a position facing the discharge surface 33*a* and a recording medium sensor 42 configured to detect the recording medium M, as depicted in FIG. 3, in any one of the first to third second embodiments. The controller 20 executes a fourth determining processing of determining, based on a result of detection by the recording medium sensor 42, occurrence and elimination of a jam (paper jam) of the recording medium M. In a case that the controller 20 determines, by the fourth determining processing, that the jam has occurred, the controller 20 makes the first flushing interval after the elimination of the jam to be shorter than the first flushing interval before the occurrence of the jam.

Specifically, the recording medium sensor 42 has, for example, a light-emitting part and a light-receiving part, and is provided on a conveyance path in which the recording medium M is conveyed by the conveying device 14. The light-emitting part and the light-receiving part are arranged so as to sandwich the recording medium M, which is being conveyed by the conveying device 14, therebetween. In a state that a light from the light-emitting part is shielded or cut off by the recording medium M and that the light-receiving part does not receive the light from the light-emitting part, the recording medium sensor 42 detects the recording medium M in the conveyance path, and outputs a detection signal to the controller 20. On the other hand, in a state that there is not any recording medium M present in the conveyance path and that the light-receiving part receives the light from the light-emitting part, the recording medium sensor 42 does not output the detection signal to the controller 20. Note that in the case that the light-receiving part receives the light from the light-emitting part, the recording medium sensor 42 may output a signal, indicating that there is not any recording medium M present in the conveyance path, to the controller 20.

Figure 8:
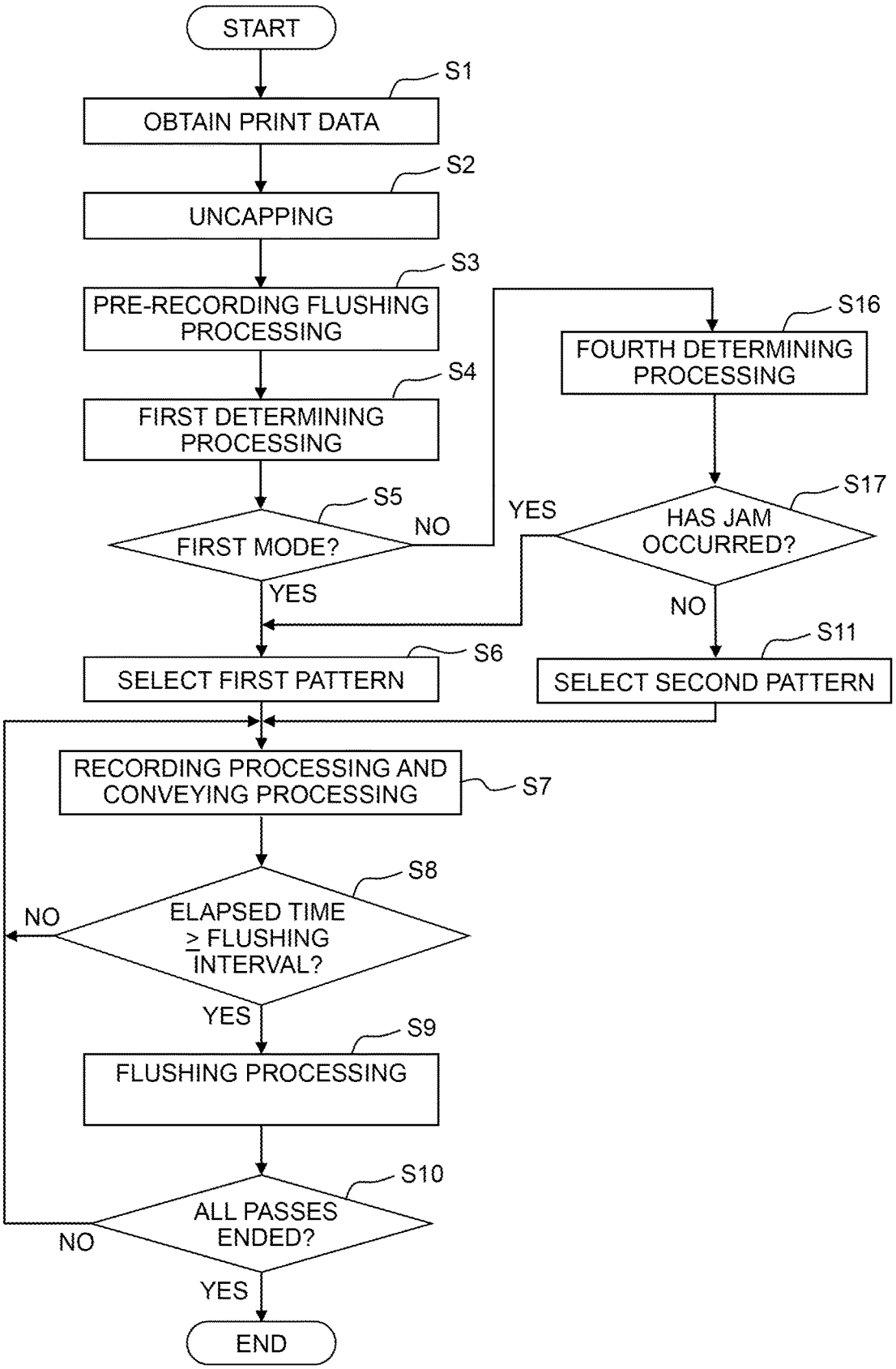
FIG. 8 is a flow chart indicating an example of a method of controlling the liquid discharging apparatus, according to a fourth embodiment of the present disclosure.

In a flow chart of a method of controlling the liquid discharging apparatus 10 as depicted in FIG. 8, the controller 20 executes processings of step S16 and step S17 between step S5 and step S11 in the flow chart depicted in FIG. 5. In a case that the controller 20 determines, by the first determining processing, that the recording processing is to be executed in the second mode (step S5: NO), the controller 22 executes the fourth determining processing in step S16.

In the fourth determining processing, in a case that a state that the recording medium M is not detected by the recording medium sensor 42 is changed to a state that the recording medium M is detected by the recording medium sensor 42, the controller 20 determines that a front end of the recording medium M has reached the recording medium sensor 42. On the other hand, in a case that the state that the recording medium M is detected by the recording medium sensor 42 is changed to the state that the recording medium M is not detected by the recording medium sensor 42, the controller 20 determines that a rear end of the recording medium M has passed the recording medium sensor 42. The controller 20 counts a conveying time between a timing at which the front end of the recording medium M has reached the recording medium sensor 42 and a timing at which the rear end of the recording medium M has passed the recording medium sensor 42. In a case that the conveying time is less than a predetermined time, the controller 20 determines that the recording medium M is being conveyed in the conveyance path smoothly, and that any jam does not occur. On the other hand, in a case that the conveying time has reached the predetermined time, the controller 20 determines that the recording medium M is not conveyed, and that a jam has occurred. Further, in a case that the recording medium sensor 42 stops detecting the recording medium M after the controller 20 had determined that the jam occurred, the controller 20 determines that the recording medium M is removed from the conveyance path, and that the jam is eliminated.

In step S17, in a case that the controller 20 determines, by the fourth determining processing, that the jam has not occurred (step S17: NO), the controller 20 selects the flushing interval of the second pattern (step S11). On the other hand, in a case that the controller 20 determines, by the fourth determining processing, that the jam has occurred (step S17: YES), the controller selects the flushing interval of the first pattern, regarding after the elimination of the jam (step S6).

In such a manner, in a case that the jam has occurred, a state that the discharge surface 33*a* is exposed is continued, and thus there is such a possibility that the liquid in the plurality of nozzles 31 might be dried. Accordingly, by selecting the first pattern, after the elimination of the jam, so as to make the first flushing interval to be shorter than that in the second pattern, thereby making it possible to lower the occurrence of any unsatisfactory discharge due to the increase in the viscosity of the liquid. On the other hand, in a state that the jam has not occurred, the second pattern is selected to thereby make it possible to perform a high-speed printing.

Fifth Embodiment

A liquid discharging apparatus 10 according to a fifth embodiment of the present disclosure is provided with a temperature sensor 43 configured to detect the temperature of the liquid, as depicted in FIG. 3, in any one of the first to fourth embodiments. The controller 20 executes a fifth determining processing of determining, based on a result of detection by the temperature sensor 43, whether or not the temperature of the liquid is not less than a predetermined temperature. In a case that the controller 20 determines, by the fifth determining processing, that the temperature of the liquid is less than the predetermined temperature, the controller 20 makes the first flushing interval to be shorter than that in a case that the controller 20 determines, by the fifth determining processing, that the temperature of the liquid is not less than the predetermined temperature.

Specifically, the temperature sensor 43 is arranged inside the liquid discharging apparatus 10 or in the head 30 so that the temperature sensor 43 detects the temperature of the liquid directly or indirectly. For example, the temperature sensor 43 is mounted on the carriage 12*a*, and moves in the left-right direction together with the carriage 12*a*. In a case that the temperature sensor 43 detects the temperature of the liquid indirectly, the controller 20 obtains the temperature of the liquid inside the head 30 from a detected temperature by the temperature sensor 43, based on predetermined information indicating a corresponding relationship between the detected temperature by the temperature sensor 43 and the temperature of the liquid.

Figure 9:
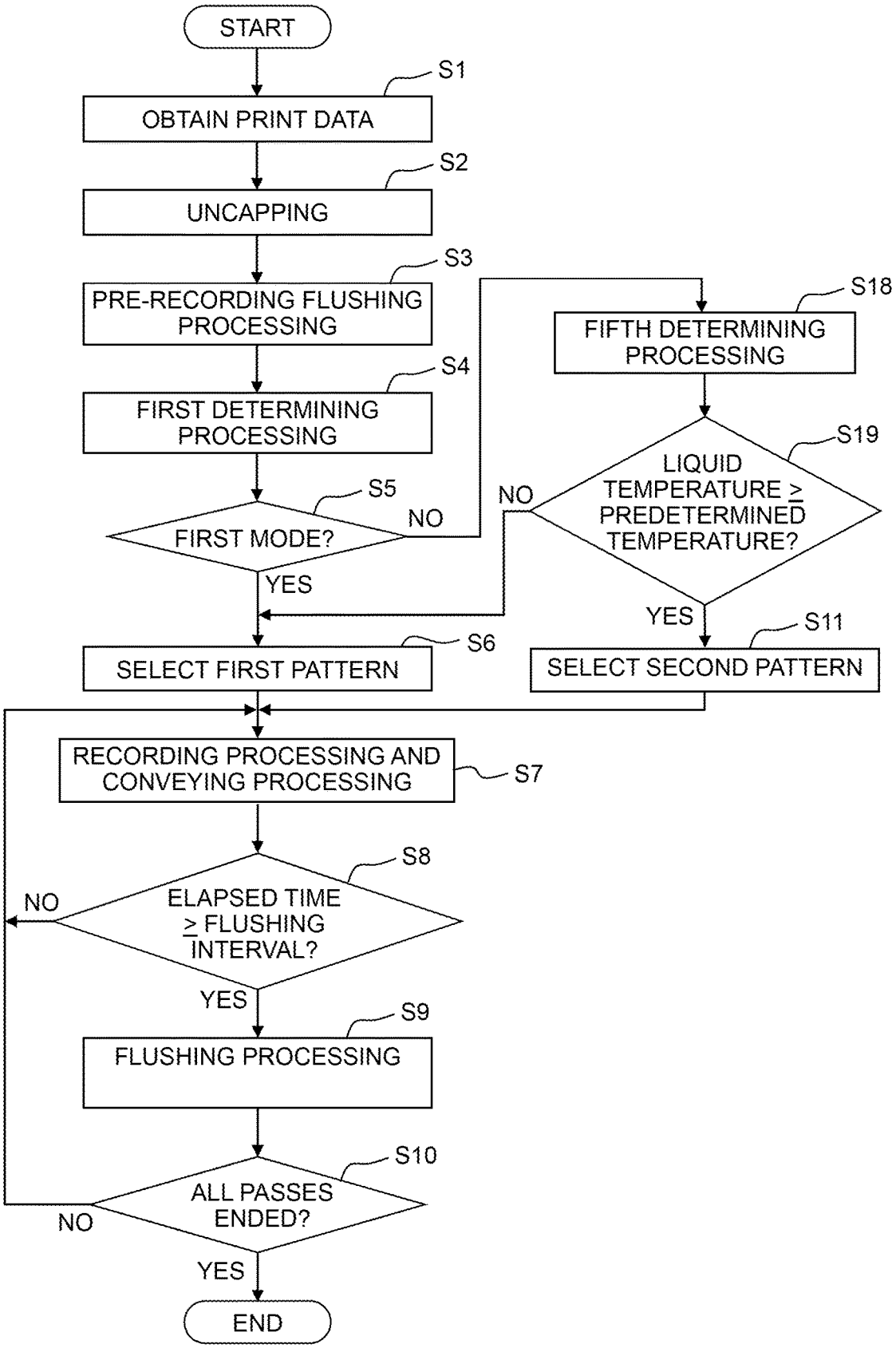
FIG. 9 is a flow chart indicating an example of a method of controlling the liquid discharging apparatus, according to a fifth embodiment of the present disclosure.

In a flow chart of a method of controlling the liquid discharging apparatus 10 as depicted in FIG. 9, the controller 20 executes processings of step S18 and step S19 between step S5 and step S11 in the flow chart depicted in FIG. 5. In a case that the controller 20 determines, by the first determining processing, that the recording processing is to be executed in the second mode (step S5: NO), the controller 22 executes the fifth determining processing in step S18, and thereby determines whether or not the temperature of the liquid inside the head 30, based on the detected temperature by the temperature sensor 43, is not less than the predetermined temperature.

In step S19, in a case that the controller 20 determines, by the fifth determining processing, that the temperature of the liquid is not less than the predetermined temperature (step S19: YES), the controller selects the flushing interval of the second pattern (step S11). On the other hand, in a case that the controller 20 determines, by the fifth determining processing, that the temperature of the liquid is less than the predetermined temperature (step S19: NO), the controller 20 selects the flushing interval of the first pattern (step S6).

In such a manner, as the temperature of the liquid is lower, the viscosity of the liquid becomes higher, and any unsatisfactory discharge of the liquid is likely to occur. Accordingly, in a case that the temperature of the liquid is less than the predetermined temperature, the first pattern is selected and the first flushing interval is made to be shorter than the first flushing interval in the second pattern, thereby making it possible to lower the occurrence of any unsatisfactory discharge due to the increase in the viscosity of the liquid. On the other hand, in a case that the temperature of the liquid is not less than the predetermined temperature, the second pattern is selected to thereby make it possible to perform a high-speed printing.

Sixth Embodiment

A liquid discharging apparatus 10 according to a sixth embodiment of the present disclosure is provided with a humidity sensor 44 configured to detect the humidity inside the liquid discharging apparatus 10, as depicted in FIG. 3, in any one of the first to fifth embodiments. The controller 20 executes a sixth determining processing of determining, based on a result of detection by the humidity sensor 44, whether the humidity inside the liquid discharging apparatus 10 is not less than a predetermined humidity. In a case that the controller 20 determines, by the sixth determining processing, that the humidity inside the liquid discharging apparatus 10 is less than the predetermined humidity, the controller 20 makes the first flushing interval to be shorter than the first flushing interval in a case that the controller 20 determines that the humidity inside the liquid discharging apparatus 10 is not less than the predetermined humidity.

Specifically, the humidity sensor 44 is arranged inside the liquid discharging apparatus 10 so that the humidity sensor 44 detects the humidity inside the liquid discharging apparatus 10 directly or indirectly. For example, the humidity sensor 44 is mounted on the carriage 12*a*, and moves in the left-right direction together with the carriage 12*a*. In a case that the humidity sensor 44 detects the humidity inside the liquid discharging apparatus 10 indirectly, the controller 20 obtains the humidity inside the liquid discharging apparatus 10 from a detected humidity by the humidity sensor 44, based on predetermined information indicating a corresponding relationship between the detected humidity by the humidity sensor 44 and the humidity inside the liquid discharging apparatus 10.

Figure 10:
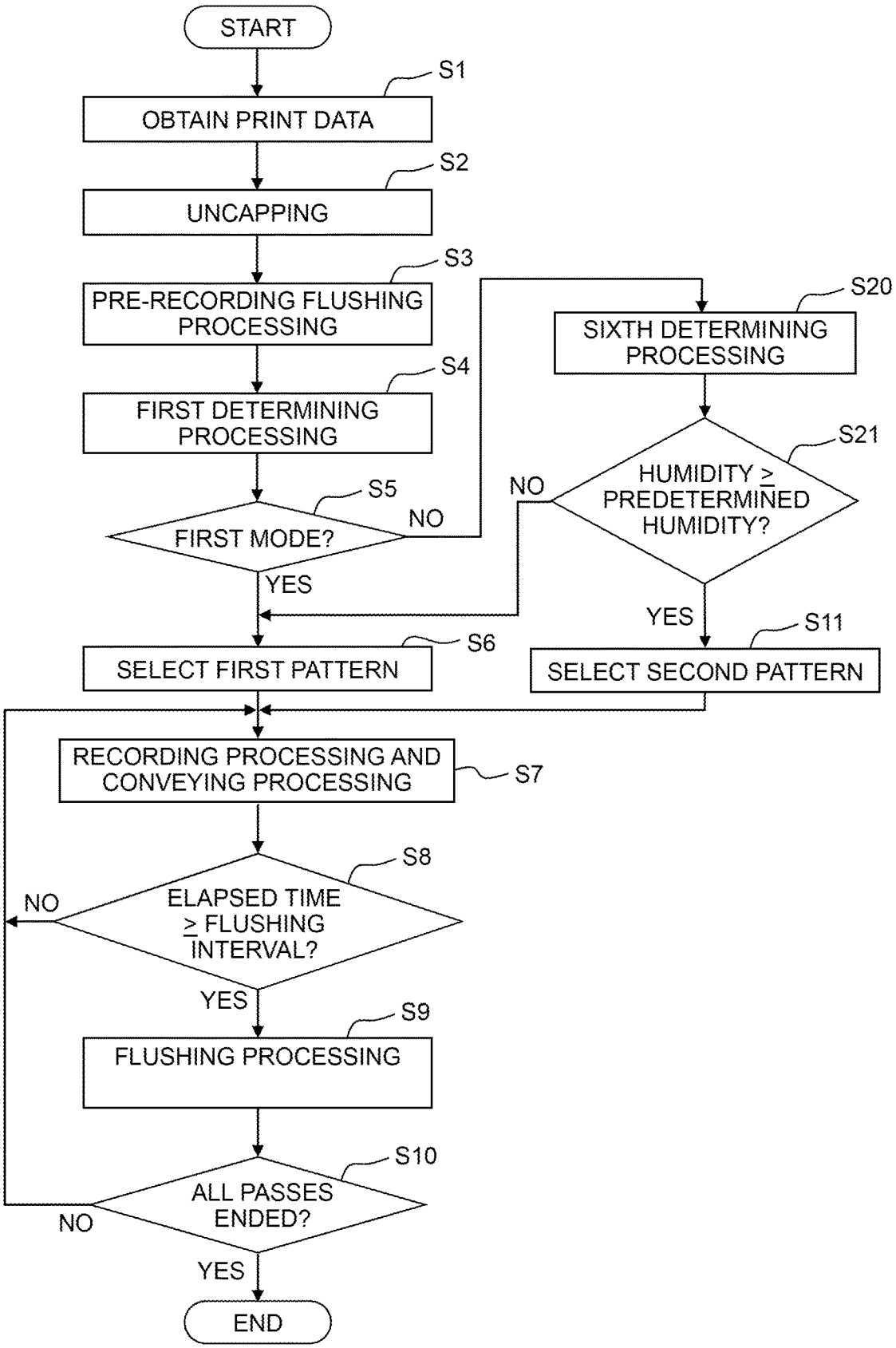
FIG. 10 is a flow chart indicating an example of a method of controlling the liquid discharging apparatus, according to a sixth embodiment of the present disclosure.

In a flow chart of a method of controlling the liquid discharging apparatus 10 as depicted in FIG. 10, the controller 20 executes processings of step S20 and step S21 between step S5 and step S11 in the flow chart depicted in FIG. 5. In a case that the controller 20 determines, by the first determining processing, that the recording processing is to be executed in the second mode (step S5: NO), the controller 20 executes the sixth determining processing in step S20, and thereby determines whether or not the humidity inside the liquid discharging apparatus 10, based on the detected humidity by the humidity sensor 44, is not less than the predetermined humidity.

In step S21, in a case that the controller 20 determines, by the sixth determining processing, that the humidity inside the liquid discharging apparatus 10 is not less than the predetermined humidity (step S21: YES), the controller 20 selects the flushing interval of the second pattern (step S11). On the other hand, in a case that the controller 20 determines, by the sixth determining processing, that the humidity inside the liquid discharging apparatus 10 is less than the predetermined humidity (step S21: NO), the controller 20 selects the flushing interval of the first pattern (step S6).

In such a manner, as the humidity inside the liquid discharging apparatus 10 is lower, the viscosity of the liquid becomes higher, and any unsatisfactory discharge of the liquid is likely to occur. Accordingly, in a case that the humidity inside the liquid discharging apparatus 10 is less than the predetermined humidity, the first pattern is selected and the first flushing interval is made to be shorter than the first flushing interval in the second pattern, thereby making it possible to lower the occurrence of any unsatisfactory discharge due to the increase in the viscosity of the liquid. On the other hand, in a case that the humidity inside the liquid discharging apparatus 10 is not less than the predetermined humidity, the second pattern is selected to thereby make it possible to perform a high-speed printing.

Seventh Embodiment

In a seventh embodiment of the present disclosure, the controller 20 executes a third flushing processing of discharging the liquid from the nozzles 31 to the receiving part 17, the third flushing processing being executed after the second flushing processing, while the controller 20 is executing the recording processing. In a case that the controller 20 determines, by the first determining processing, that the recording processing is to be executed in the second mode, the controller 20 makes a third flushing interval between the second flushing processing and the third flushing processing to be shorter than the second flushing interval.

Figure 11:
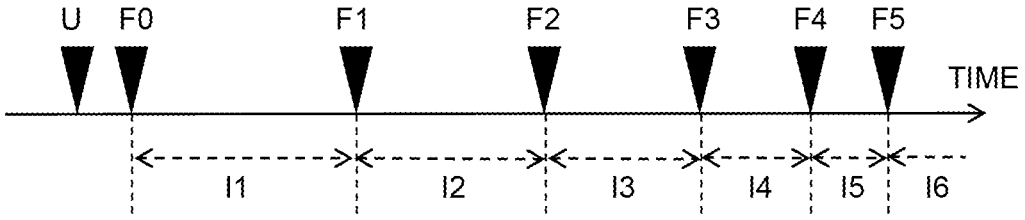
FIG. 11 is a flow chart indicating a flushing interval of a third pattern in a liquid discharging apparatus, according to a seventh embodiment of the present disclosure.

Namely, in the flowcharts indicates in FIGS. 5 to 10, respectively, the controller 20 selects, for example, a flushing interval of a third pattern, instead of selecting the flushing interval of the second pattern in step S11. For example, in the flushing interval of the third pattern as depicted in FIG. 11, the second flushing interval I2 is shorter than the first flushing interval I1, and the third flushing interval 13 is shorter than the second flushing interval 13. The first flushing interval I1 of the third pattern is longer than the first flushing interval I1 of the first pattern.

For example, the first flushing interval I1 is 60 (sixty) seconds, the second flushing interval I1 is 50 (fifty) seconds, and the third flushing interval I1 is 40 (forty) seconds. By making the flushing interval to be shorter as the printing processing progresses, the flushing processing is executed at an appropriate timing with respect to any drying of the liquid inside the plurality of nozzles 31 which advances as the time passes. As a result, it is possible to lower the occurrence of any unsatisfactory discharge due to the increase in the viscosity of the liquid while maintaining the high-speed printing.

Note that in the recording processing of the second mode, it is allowable that the flushing interval is made to be shorter in a stepwise manner as the printing processing progresses, as depicted in FIG. 11. In this case, after the flushing interval reaches a predetermined interval (for example, 10 (ten) seconds), the controller 20 may maintain a flushing interval(s) thereafter at a predetermined interval, without shortening the flushing interval(s) thereafter than the predetermined interval. By doing so, it is possible to suppress such a situation that the flushing interval becomes to be too short and that the time required for the printing processing becomes to be too long.

Eighth Embodiment

A liquid discharging apparatus 10 according to an eighth embodiment of the present disclosure is provided with a temperature sensor 43 configured to detect the temperature of the liquid, as depicted in FIG. 3, in any one of the first to fourth embodiments. The controller 20 executes a third flushing processing of discharging the liquid from the plurality of nozzles 31 to the receiving part 17, the third flushing processing being executed after the second flushing processing, while the controller 20 is executing the recording processing. The controller 20 executes a seventh determining processing of determining whether or not the temperature of the liquid is not less than a predetermined temperature. In a case that the controller 20 determines, by the seventh determining processing, that the temperature of the liquid is less than the predetermined temperature, the controller 20 makes a third flushing interval between the second flushing processing and the third flushing processing to be shorter than the second flushing interval.

Figure 12A:
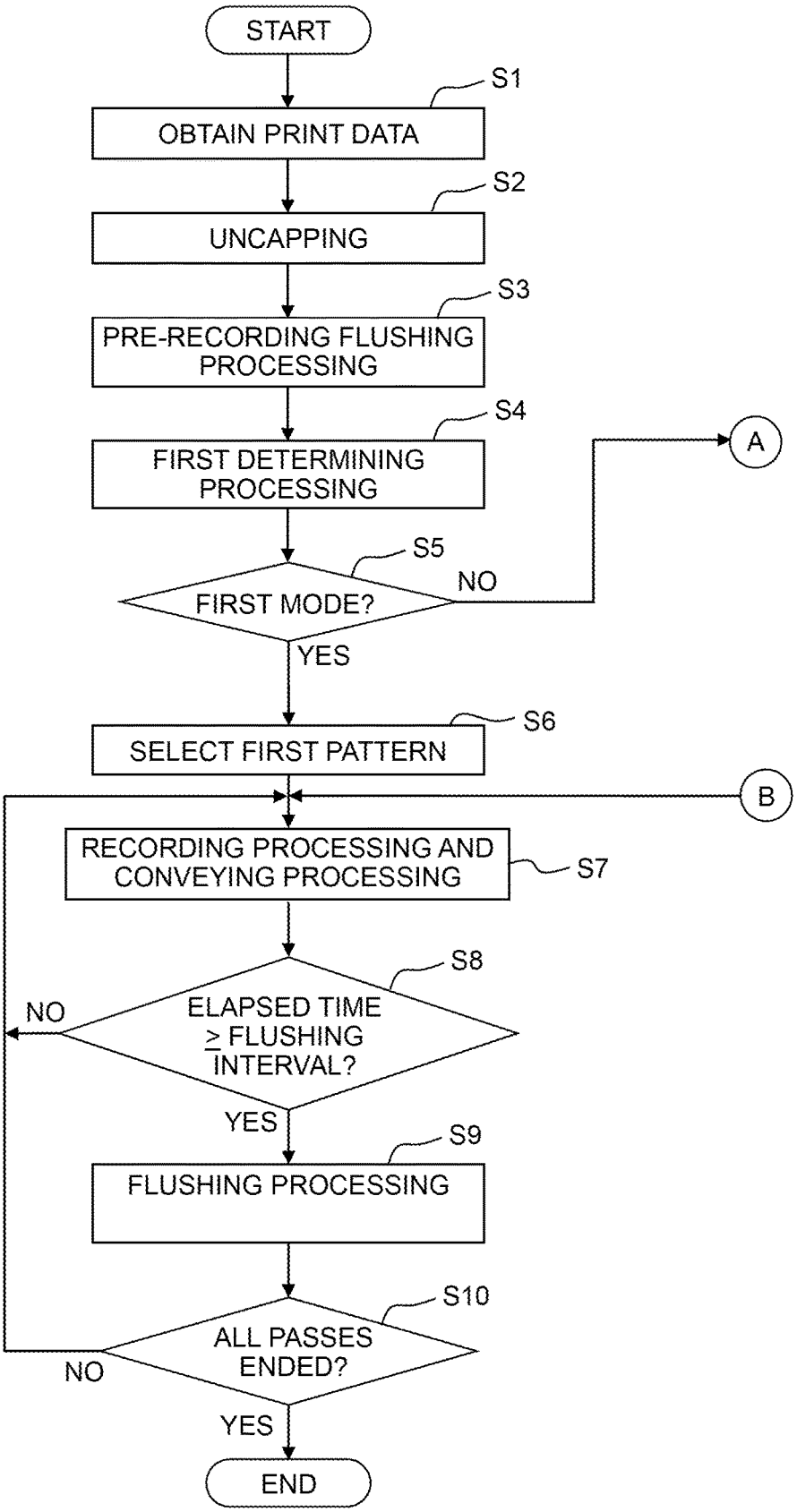
FIGS. 12A and 12B are a flow chart indicating an example of a method of controlling the liquid discharging apparatus, according to an eighth embodiment of the present disclosure.
Figure 12B:
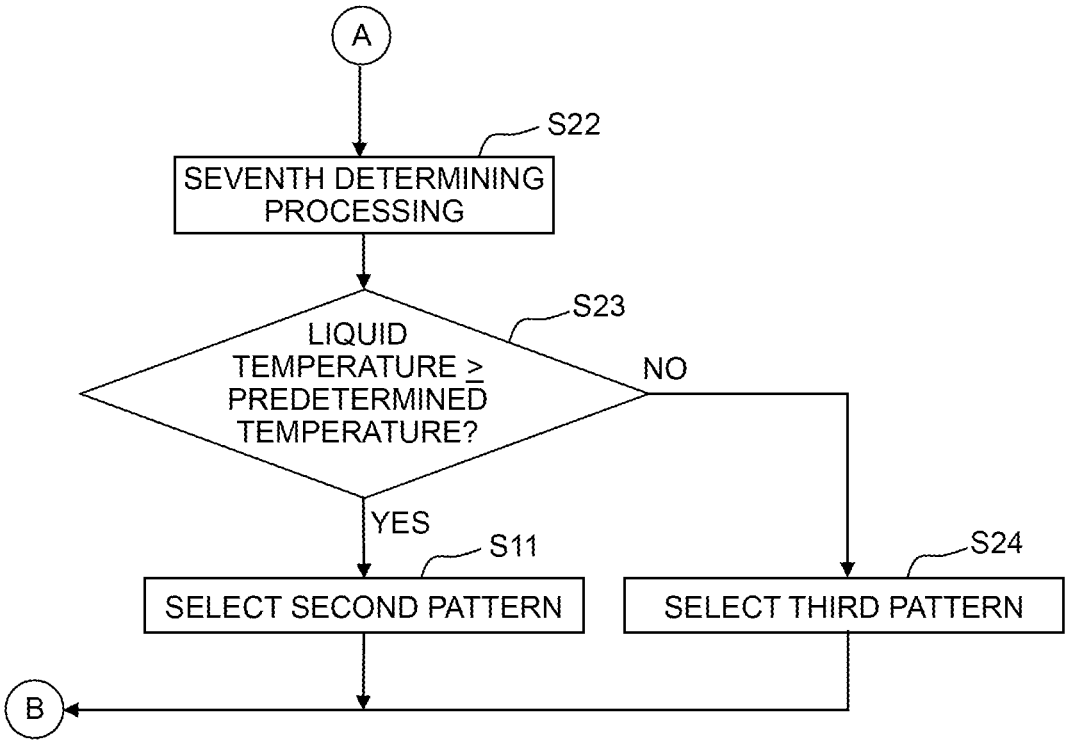

In a flow chart of a method of controlling the liquid discharging apparatus 10 as depicted in FIGS. 12A and 12B, the controller 20 executes processings of step S22 to step S24 between step S5 and step S7 in the flow chart depicted in FIG. 5. In a case that the controller 20 determines, by the first determining processing, that the recording processing is to be executed in the second mode (step S5: NO), the controller 22 executes the seventh determining processing in step S22, and thereby determines whether or not the temperature of the liquid inside the head 30 based on the detected temperature by the temperature sensor 43 is not less than a predetermined temperature.

In step S23, in a case that the controller 20 determines, by the seventh determining processing, that the temperature of the liquid is not less than the predetermined temperature (step S23: YES), the controller 20 selects the flushing interval of the second pattern (step S11). On the other hand, in a case that the controller 20 determines, by the seventh determining processing, that the temperature of the liquid is less than the predetermined temperature (step S23: NO), the controller selects the flushing interval of the third pattern (step S24).

In such a manner, in a case that the temperature of the liquid is less than the predetermined temperature, the viscosity of the liquid becomes to be high, and any unsatisfactory discharge of the liquid is likely to occur. In this case, by selecting the third pattern, the third flushing interval becomes to be shorter than the second flushing interval, and the flushing interval becomes to be shorter accompanying with the progress of the printing processing. As a result, it is possible to lower the occurrence of any unsatisfactory discharge due to the increase in the viscosity of the liquid. On the other hand, in a case that the temperature of the liquid is not less than the predetermined temperature, the second pattern is selected to thereby make it possible to perform a high-speed printing.

Nineth Embodiment

A liquid discharging apparatus 10 according to a nineth embodiment of the present disclosure is provided with a humidity sensor 44 configured to detect the humidity inside the liquid discharging apparatus 10, as depicted in FIG. 3, in any one of the first to fifth embodiments. The controller 20 executes a third flushing processing of discharging the liquid from the plurality of nozzles 31 to the receiving part 17, the third flushing processing being executed after the second flushing processing, while the controller 20 is executing the recording processing. The controller 20 executes an eighth determining processing of determining whether or not the humidity inside the liquid discharging apparatus 10 is not less than a predetermined humidity. In a case that the controller 20 determines, by the eighth determining processing, that the humidity inside the liquid discharging apparatus 10 is less than the predetermined humidity, the controller 20 makes a third flushing interval between the second flushing processing and the third flushing processing to be shorter than the second flushing interval.

Figure 13A:
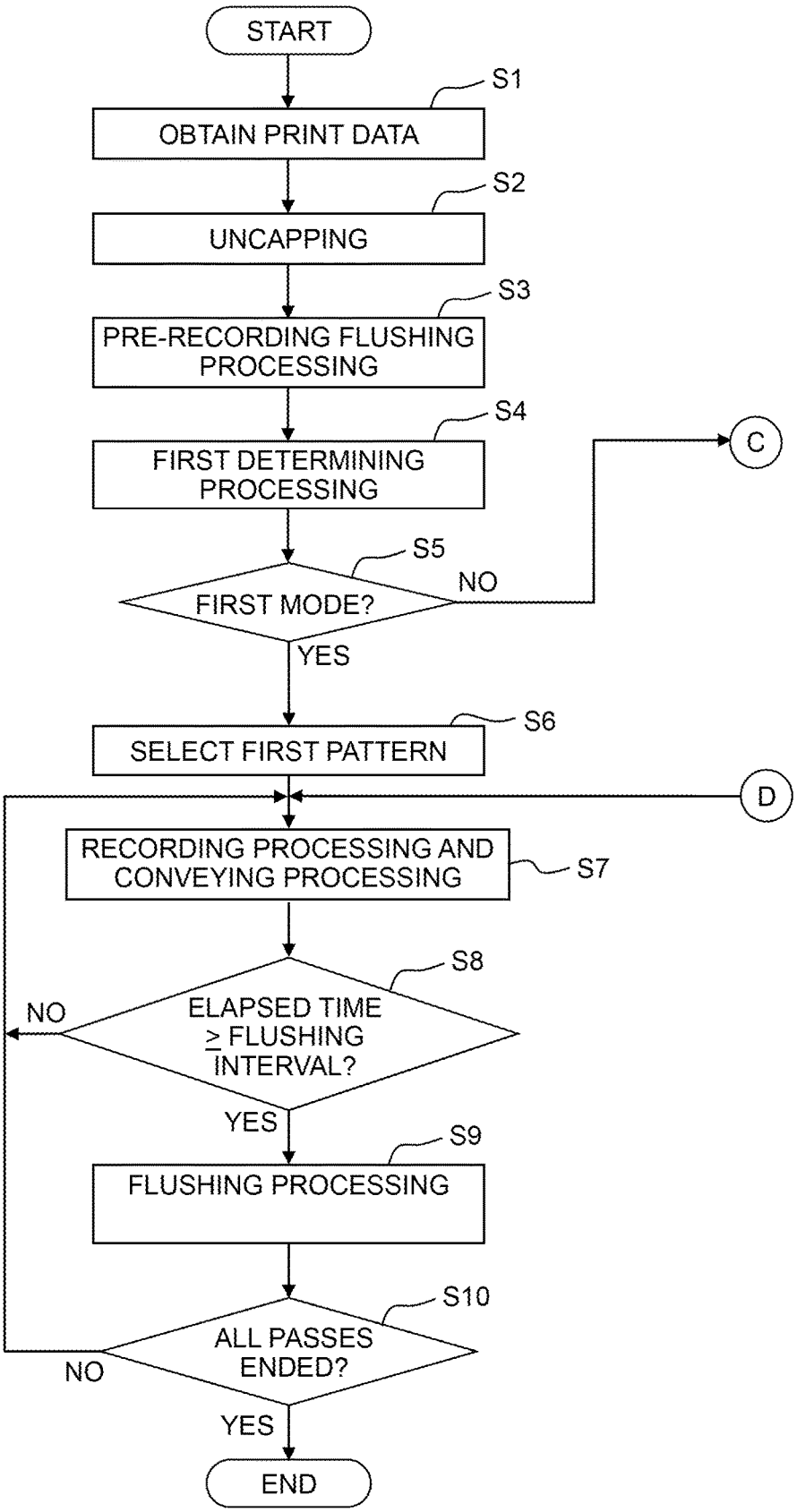
FIGS. 13A and 13B are a flow chart indicating an example of a method of controlling the liquid discharging apparatus, according to a ninth embodiment of the present disclosure.
Figure 13B:
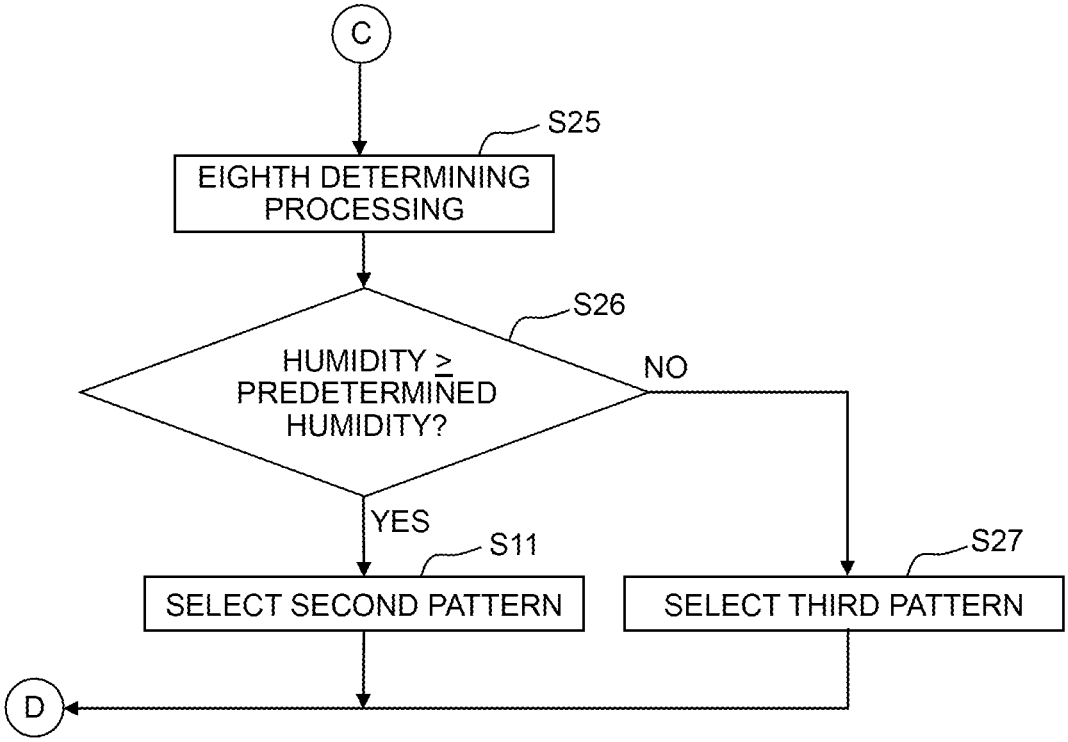

In a flow chart of a method of controlling the liquid discharging apparatus 10 as depicted in FIGS. 13A and 13B, the controller 20 executes processings of step S25 to step S27 between step S5 and step S7 in the flow chart depicted in FIG. 5. In a case that the controller 20 determines, by the first determining processing, that the recording processing is to be executed in the second mode (step S5: NO), the controller 22 executes the eighth determining processing in step S25, and thereby determines whether or not the humidity inside the liquid discharging apparatus 10 based on the detected humidity by the humidity sensor 44 is not less than a predetermined humidity.

In step S26, in a case that the controller 20 determines, by the eighth determining processing, that the humidity inside the liquid discharging apparatus 10 is not less than the predetermined humidity (step S26: YES), the controller selects the flushing interval of the second pattern (step S11). On the other hand, in a case that the controller 20 determines, by the eighth determining processing, that the humidity inside the liquid discharging apparatus 10 is less than the predetermined humidity (step S26: NO), the controller 20 selects the flushing interval of the third pattern (step S27).

In such a manner, in a case that the humidity inside the liquid discharging apparatus 10 is less than the predetermined humidity, the viscosity of the liquid becomes to be high, and any unsatisfactory discharge of the liquid is likely to occur. In this case, by selecting the third pattern, the third flushing interval becomes to be shorter than the second flushing interval, and the flushing interval becomes to be shorter accompanying with the progress of the printing processing. As a result, it is possible to lower the occurrence of any unsatisfactory discharge due to the increase in the viscosity of the liquid. On the other hand, in a case that the humidity inside the liquid discharging apparatus 10 is not less than the predetermined humidity, the second pattern is selected to thereby make it possible to perform a high-speed printing.

Tenth Embodiment

In a liquid discharging apparatus 10 according to a tenth embodiment of the present disclosure, the controller 20 executes the recording processing for each pass in any one of the first to nineth embodiments. The controller 20 executes a plurality of flushing processings of discharging the liquid from the nozzles 31 to the receiving part 17 in the recording processing. The controller 20 executes a ninth determining processing of determining whether a discharge amount (accumulated discharge amount) of the liquid discharged from the nozzles 31 in the recording processing up to the pass performed last time is not less than a predetermined liquid amount. In a case that the controller 20 determines, by the ninth determining processing, that the accumulated discharge amount is not less than the predetermined liquid amount, the controller 20 is configured to make a next-time flushing interval between a current flushing processing and a next-time flushing processing to be longer than a last-time flushing interval between a last-time flushing processing and the current flushing processing.

Specifically, in a case that the controller 20 determines, by the first determining processing, that the recording processing is to be executed in the second mode, the controller 20 selects the flushing interval of the second pattern. Then, the controller 20 executes the flushing processing at the flushing interval of the second pattern. In a case that the controller 20 executes the flushing, the controller 20 executes the ninth determining processing.

In the nineth determining processing, for example, the controller 20 calculates a discharge duty up to the pass performed last time as the accumulated discharge amount of the liquid. The discharge duty is a discharge amount, of the liquid, with respect to a maximum total amount of dischargeable amounts of the plurality of nozzles 31 opened in the discharge surface 33*a* up to the pass performed last time. The maximum total amount of dischargeable amounts is an amount obtained by adding a maximum discharge amount of the liquid which can be discharged from each of the plurality of nozzles 31 at one time of driving, with respect to all the plurality of nozzles 31 in the pass and all the driving cycles, and stored in the storing part 22 in advance. The discharge amount of the liquid is calculated as follows: an amount of liquid droplets to be discharged from each of the plurality of nozzles 31 at each of the driving cycles is obtained from the density of an image based on the print data, and such liquid droplet amounts are added with respect to all the plurality of nozzles 31 in the pass and with respect to the all the driving cycles in the pass.

For example, it is assumed that the large drop is formed by the maximum amount of the liquid droplet which is discharged from one nozzle 31 by one time of the driving. In this case, since liquid droplets of the large drop are discharged from the plurality of nozzles 31 by all the drivings of a current pass, this discharge amount of the liquid corresponds to the maximum total amount of dischargeable amounts of the plurality of nozzles 31, and thus the discharge duty becomes to be 100%. On the other hand, in a case that the liquid droplets are not discharged from the plurality of nozzles 31 by all the drivings of the current pass, this discharge amount of the liquid is 0 (zero), and thus the discharge duty becomes to be 0%. The controller 20 calculates the discharge duty based on the print data for each pass. Further, the controller 20 stores, in a predetermined area of the storing part 22, the calculated discharge duty and an average value of the calculated discharge duty and a discharge duty which has been already stored. Furthermore, the controller 20 uses this average value as the accumulated discharge amount of the liquid.

Then, in a case that the controller 20 determines, by the nineth determining processing, that the accumulated discharge amount is less than the predetermined liquid amount, the controller 20 executes the flushing based on the flushing interval of the second pattern.

On the other hand, in a case that the controller 20 determines, by the nineth determining processing, that the accumulated discharge amount is not less than the predetermined liquid amount, the controller 20 obtains a last-time flushing interval between the current flushing processing and the last-time flushing processing which has been executed immediately before the current flushing. Then, the controller 20 changes the next-time flushing interval between the current flushing processing and the next-time flushing processing which is to be executed next to the current flushing processing to be longer than the last-time flushing interval. For example, in a case that the last-time flushing interval is 10 seconds, the controller 20 makes the next-time flushing interval to be 20 seconds which is longer than the last-time flushing interval.

Since the liquid is discharged or ejected from the plurality of nozzles 31 in the discharging operation based on the print information in the recording processing, the discharging operation can be considered as a kind of the flushing processing. Therefore, as the discharge duty up to the last-time pass is greater, any unsatisfactory discharge of the liquid is less likely to occur. Thus, in a case that the accumulated discharge amount is not less than the predetermined liquid amount, the next-time flushing interval is made to be longer than the last-time flushing interval. With this, it is possible to perform a high-speed printing while lowering the occurrence of any unsatisfactory discharge due to the increase in the viscosity of the liquid.

Note that in the ninth determining processing as described above, the discharge duty is used as the accumulated discharge amount. The accumulated discharge amount, however, is not limited to this. For example, it is allowable to use an integrated quantity of the liquid and a printing rate as the accumulated discharge amount. The integrated amount of the liquid is an amount obtained by adding the amounts of the liquid discharged from the plurality of nozzles 31 up to the pass performed last time. In this case, the controller 20 obtains the liquid droplet amount to be discharged from each of the plurality of nozzles 31 at each of the driving cycles from the density of the image based on the print data. Then, the controller 20 calculates a total amount by adding thus obtained liquid droplet amounts with respect to all the plurality of nozzles 31 and with respect to all the driving cycles in the pass. Then, the controller 20 adds the calculated total amount to a previously stored total amount to thereby obtain a sum, and stores the sum in the storing part 22. Further, the controller 20 uses the stored total amount as the accumulated discharge amount of the liquid.

Further, the printing rate is a value obtained by dividing a density and an area of an image formed by the discharged liquid with an area of a print range in the recording medium M. For example, in a case that the density of the image in 50% of the print range is 50%, and the density of the image in the remaining 50% of the print range is 0%, the printing rate is 25%.

Every time the controller 20 performs the printing on the recording medium M, the controller 20 calculates the printing rate from the density and area of the image and the area of the print range, based on the print data. Further, the controller 20 stores, in a predetermined area of the storing part 20, the average of the calculated printing rate and a printing rate which has been already stored in the predetermined area of the storing part 20. Furthermore, the controller 20 uses the average value as the accumulated discharge amount of the liquid.

Eleventh Embodiment

A liquid discharging apparatus 10 according to an eleventh embodiment of the present disclosure is provided with, as depicted in FIG. 3, a scanning device 15 configured to move the head 30 in the scanning direction. The controller 20 makes a discharging number of time of discharging the liquid from the plurality of nozzles 31 and a discharge amount of the liquid from the plurality of nozzles 31 in each of the first flushing processing and the second flushing processing to be within a range so that the liquid is receivable by the receiving part 17 in a case that the liquid is discharged from the plurality of nozzles 31 while the head 30 is being moved.

In the flushing processing, the liquid is discharged from the plurality of nozzles 31 while the head 30 is moving and accelerating in the flushing area A. In such a situation, the controller 20 drives the plurality of driving elements 32 so that the discharged liquid enters into the receiving part 17. Namely, the controller 20 calculates a landing position of the liquid from a moving speed of the head 30, a spacing distance between the discharge surface 33*a* and the receiving part 17, a flying speed of the liquid corresponding to the driving signal, etc., and controls the driving timing of the plurality of driving elements 32, etc., so that the landing position is within a range of the receiving part 17 in the left-right direction.

Note that the liquid is discharged from the plurality of nozzles 31 while the head 30 is moving rightward (to the right side). Accordingly, the landing position of the discharged liquid is located on the right side with respect to a discharge position of the liquid. Therefore, the head 30 starts the discharge of the liquid on the upstream side (left side) in the moving direction of the head 30 with respect to a left end of the receiving part 17, and ends the discharge of the liquid on the upstream side (left side) in the moving direction of the head 30 with respect to a right end of the receiving part 17. By doing so, the discharged liquid is received by the receiving part 17.

In such a manner, the liquid discharged from the plurality of nozzles 31 by the flushing processing lands on the absorbing body 17*a* and the guide 17*b* of the receiving part 17. Therefore, it is possible to prevent occurrence of such a situation that the liquid lands and accumulates on a part, which is different from the receiving part 17, etc., to thereby form an accumulated matter, and that the movement of the head 30 is hindered by the accumulated matter, etc.

Further, in the flushing processing, the scanning operation and the discharging operation of the head 30 are executed in parallel. A moving velocity of the head 30 in the flushing processing is equal to the velocity of the head 30 which is moving in the flushing area A without executing the flushing processing. Thus, it is possible to suppress any lowering in the speed of the printing processing due to the flushing processing.

Other Modifications

In all the above-described embodiments, the maintenance area C and the flushing area A are arranged on the opposite sides, respectively, with the recording area B interposed therebetween. It is allowable, however, that the maintenance area C and the flushing area A are arranged on a same side with respect to the recording area B. Further, although the receiving part 17 is provided separately from the cap 18*a*, it is allowable to use the cap 18*a* as the receiving part 17. In such a case, the maintenance area C and the flushing area A are a mutually same area.

In all the above-described embodiments, the flushing interval of the first pattern or the flushing interval of the second pattern is selected, depending on the result of the determination in each of the determining processings. Note, however, it is allowable that the flushing interval of the first pattern is set as a basic pattern, and that the flushing interval is changed from that of the first pattern to that of the second pattern, depending on the result of the determination in each of the determining processings. In such a case, the controller 20 returns the flushing interval to be that of the first pattern after the controller 20 ends the recording processings in all the passes.

In all the above-described embodiments, it is allowable to execute a non-discharging driving of each of the plurality of driving elements 32 after the recording processing and immediately before executing the flushing processing. By the non-discharging driving, the meniscus in the opening of the nozzle 31, communicating with the pressure chamber 35*b* is vibrated so that the liquid is not discharged from the nozzle 31. Thus, it is possible to easily discharge the liquid from the nozzle 31 in the flushing processing executed after the non-discharging driving of each of the plurality of driving elements 32.

Note that all the above-described embodiments and modifications may be combined with each other, provided that the embodiments and modifications are not mutually exclusive. Further, many improvements and/or another embodiment of present disclosure will be apparent, from the foregoing explanation, to those skilled in the art. Accordingly, the foregoing explanation should be construed as illustrative only, and is provided for the purpose of teaching those skilled in the art the best mode for carrying out present disclosure. The details of the configuration and/or the details of function of the present disclosure may be substantially changed, without departing from the spirit of the present disclosure.

The liquid discharging apparatus, the controlling method for the same and the program related to the present disclosure are useful as a liquid discharging apparatus, a controlling method for the same and a program, etc., each of which is capable of balancing the quality of printed image and the printing time.

What is claimed is:

1. A liquid discharging apparatus comprising:

a head having a discharge surface in which a nozzle is opened;

a cap configured to cover the discharge surface;

a receiving part configured to receive liquid discharged from the head;

a moving device configured to move the cap between a capping position at which the cap covers the discharge surface, and an uncapping position at which the cap is separated from the discharge surface; and a controller configured to execute:

a recording processing of discharging the liquid from the nozzle to a recording medium based on print data;

a first determining processing of determining, based on the print data, whether the recording processing is to be executed in a first mode or a second mode in which a processing speed is faster than that in the first mode;

a pre-recording flushing processing of discharging the liquid from the nozzle to the receiving part after uncapping of the cap and before the recording processing;

a first flushing processing of discharging the liquid from the nozzle to the receiving part in the recording processing; and a second flushing processing of discharging the liquid from the nozzle to the receiving part in the recording processing, the second flushing processing being executed after the first flushing processing, wherein in a case that the controller determines, by the first determining processing, that the recording processing is to be executed in the second mode, the controller is configured to make a first flushing interval between the pre-recording flushing processing and the first flushing processing to be longer than a second flushing interval between the first flushing processing and the second flushing processing.

2. The liquid discharging apparatus according to claim 1, further comprising a liquid sensor configured to detect a kind of the liquid, wherein the controller is configured to further execute a second determining processing of determining whether the kind is a predetermined kind, and in a case that the controller determines, by the second determining processing, that the kind is not the predetermined kind, the controller is configured to make the first flushing interval to be shorter than the first flushing interval in a case of determining that the kind is the predetermined kind.

3. The liquid discharging apparatus according to claim 1, further comprising a timer configured to count a use time of the head, wherein the controller is configured to further execute a third determining processing of determining whether the use time is not less than a predetermined period, and in a case that the controller determines, by the third determining processing, that the use time is not less than the predetermined period, the controller is configured to make the first flushing interval to be shorter than the first flushing interval in a case of determining that the use time is less than the predetermined period.

4. The liquid discharging apparatus according to claim 1, further comprising:

a conveying device configured to convey the recording medium to a position facing the discharge surface; and a recording medium sensor configured to detect the recording medium, wherein the controller is configured to further execute a fourth determining processing of determining, based on a result of detection by the recording medium sensor, occurrence and elimination of a jam of the recording medium, and in a case that the controller determines, by the fourth determining processing, that the jam has occurred, the controller is configured to make the first flushing interval after the elimination of the jam to be shorter than the first flushing interval before the occurrence of the jam.

5. The liquid discharging apparatus according to claim 1, further comprising a temperature sensor configured to detect temperature of the liquid, wherein the controller is configured to further execute a fifth determining processing of determining whether the temperature is not less than a predetermined temperature, and in a case that the controller determines, by the fifth determining processing, that the temperature is less than the predetermined temperature, the controller is configured to make the first flushing interval to be shorter than the first flushing interval in a case of determining that the temperature is not less than the predetermined temperature.

6. The liquid discharging apparatus according to claim 1, further comprising a humidity sensor configured to detect humidity inside the liquid discharging apparatus, wherein the controller is configured to further execute a sixth determining processing of determining whether the humidity is not less than a predetermined humidity, and in a case that the controller determines, by the sixth determining processing, that the humidity is less than the predetermined humidity, the controller is configured to make the first flushing interval to be shorter than the first flushing interval in a case of determining that the humidity is not less than the predetermined humidity.

7. The liquid discharging apparatus according to claim 1, wherein the controller is configured to further execute a third flushing processing of discharging the liquid from the nozzle to the receiving part in the recording processing, the third flushing processing being executed after the second flushing processing, and in a case that the controller determines, by the first determining processing, that the recording processing is to be executed in the second mode, the controller is configured to make a third flushing interval between the second flushing processing and the third flushing processing to be shorter than the second flushing interval.

8. The liquid discharging apparatus according to claim 1, further comprising a temperature sensor configured to detect temperature of the liquid, wherein the controller is configured to further execute:

a third flushing processing of discharging the liquid from the nozzle to the receiving part in the recording processing, the third flushing processing being executed after the second flushing processing; and a seventh determining processing of determining whether the temperature is not less than a predetermined temperature, and in a case that the controller determines, by the seventh determining processing, that the temperature is less than the predetermined temperature, the controller is configured to make a third flushing interval between the second flushing processing and the third flushing processing to be shorter than the second flushing interval.

9. The liquid discharging apparatus according to claim 1, further comprising a humidity sensor configured to detect humidity inside the liquid discharging apparatus, wherein the controller is configured to further execute:

a third flushing processing of discharging the liquid from the nozzle to the receiving part in the recording processing, the third flushing processing being executed after the second flushing processing; and an eighth determining processing of determining whether the humidity is not less than a predetermined humidity, and in a case that the controller determines, by the eighth determining processing, that the humidity is less than the predetermined humidity, the controller is configured to make a third flushing interval between the second flushing processing and the third flushing processing to be shorter than the second flushing interval.

10. The liquid discharging apparatus according to claim 1, wherein the controller is configured to execute:

the recording processing for each pass;

a plurality of flushing processings of discharging the liquid from the nozzle to the receiving part in the recording processing; and a ninth determining processing of determining whether a discharge amount of the liquid discharged from the nozzle in the recording processing up to a last pass performed last time is not less than a predetermined liquid amount, and in a case that the controller determines, by the first determining processing, that the recording processing is to be executed in the second mode and that the controller determines, by the ninth determining processing, that the discharge amount is not less than the predetermined liquid amount, the controller is configured to make a next-time flushing interval between a current flushing processing and a next-time flushing processing to be longer than a last-time flushing interval between a last-time flushing processing and the current flushing processing.

11. The liquid discharging apparatus according to claim 1, further comprising a scanning device configured to move the head in a scanning direction, wherein the controller is configured to make a discharging number of time of discharging the liquid from the nozzle and a discharge amount of the liquid from the nozzle in each of the first flushing processing and the second flushing processing to be within a range so that the liquid is receivable by the receiving part in a case that the liquid is discharged from the nozzle while the head is being moved.

12. A controlling method of controlling a liquid discharging apparatus including:

a head having a discharge surface in which a nozzle is opened;

a cap configured to cover the discharge surface;

a receiving part configured to receive liquid discharged from the head;

a moving device configured to move the cap between a capping position at which the cap covers the discharge surface, and an uncapping position at which the cap is separated from the discharge surface; and a controller, the controlling method comprising causing the controller to execute:

a recording processing of discharging the liquid from the nozzle to a recording medium based on print data;

a first determining processing of determining, based on the print data, whether the recording processing is to be executed in a first mode or a second mode in which a processing speed is faster than that in the first mode;

a pre-recording flushing processing of discharging the liquid from the nozzle to the receiving part after uncapping of the cap and before the recording processing;

a first flushing processing of discharging the liquid from the nozzle to the receiving part in the recording processing; and a second flushing processing of discharging the liquid from the nozzle to the receiving part in the recording processing, the second flushing processing being executed after the first flushing processing, and in a case that the controller determines, by the first determining processing, that the recording processing is to be executed in the second mode, the controlling method causing the controller to make a first flushing interval between the pre-recording flushing processing and the first flushing processing to be longer than a second flushing interval between the first flushing processing and the second flushing processing.

13. The controlling method according to claim 12, wherein the liquid discharging apparatus further comprises:

a conveying device configured to convey the recording medium to a position facing the discharge surface; and a recording medium sensor configured to detect the recording medium, wherein the controlling method further causes the controller to execute a fourth determining processing of determining, based on a result of detection by the recording medium sensor, occurrence and elimination of a jam of the recording medium, and in a case that the controller determines, by the fourth determining processing, that the jam has occurred, the controlling method causes the controller to make the first flushing interval after the elimination of the jam to be shorter than the first flushing interval before the occurrence of the jam.

14. A non-transitory medium storing a program executable by a liquid discharging apparatus including:

a head having a discharge surface in which a nozzle is opened;

a cap configured to cover the discharge surface;

a receiving part configured to receive liquid discharged from the head;

a moving device configured to move the cap between a capping position at which the cap covers the discharge surface, and an uncapping position at which the cap is separated from the discharge surface; and a controller, in a case that the program is executed by a processor of the liquid discharging apparatus, the program causing the controller to execute:

a recording processing of discharging the liquid from the nozzle to a recording medium based on print data;

a first determining processing of determining, based on the print data, whether the recording processing is to be executed in a first mode or a second mode in which a processing speed is faster than that in the first mode;

a pre-recording flushing processing of discharging the liquid from the nozzle to the receiving part after uncapping of the cap and before the recording processing;

a first flushing processing of discharging the liquid from the nozzle to the receiving part in the recording processing; and a second flushing processing of discharging the liquid from the nozzle to the receiving part in the recording processing, the second flushing processing being executed after the first flushing processing, wherein in a case that the controller determines, by the first determining processing, that the recording processing is to be executed in the second mode, the program causes the controller to make a first flushing interval between the pre-recording flushing processing and the first flushing processing to be longer than a second flushing interval between the first flushing processing and the second flushing processing.

15. The medium according to claim 14, wherein the liquid discharging apparatus further comprises:

a conveying device configured to convey the recording medium to a position facing the discharge surface; and a recording medium sensor configured to detect the recording medium, wherein the program further causes the controller to execute a fourth determining processing of determining, based on a result of detection by the recording medium sensor, occurrence and elimination of a jam of the recording medium, and in a case that the controller determines, by the fourth determining processing, that the jam has occurred, the program causes the controller to make the first flushing interval after the elimination of the jam to be shorter than the first flushing interval before the occurrence of the jam.

* * * * *